US006144177A

United States Patent [19]

Mao

[11] Patent Number: 6,144,177

[45] Date of Patent: Nov. 7, 2000

[54] DRAPERY ACTUATOR

[76] Inventor: Kai Ming Mao, 8 Foxworth Drive, Toronto, Ontario, Canada, M2K 1L2

[21] Appl. No.: 09/176,092

[22] Filed: Oct. 21, 1998

Related U.S. Application Data

[63] Continuation-in-part of application No. 08/703,760, Aug. 27, 1996.

[51] Int. Cl.[7] ..... A47H 1/00; G05B 5/00

[52] U.S. Cl. ..... 318/466; 318/282; 318/286; 318/468; 160/331

[58] Field of Search ..... 318/480, 282, 318/286, 466, 16, 256, 445; 307/141; 160/330, 331

[56] References Cited

U.S. PATENT DOCUMENTS

| | | | |
|---|---|---|---|
| 3,809,143 | 5/1974 | Ipekgil | 160/168.1 |
| 4,096,903 | 6/1978 | Ringle, III | 160/176.1 |
| 4,554,762 | 11/1985 | Anderson | 49/74.1 |
| 4,864,201 | 9/1989 | Bernot | 318/480 |
| 4,934,438 | 6/1990 | Yuhas et al. | 160/107 |
| 5,278,480 | 1/1994 | Murray | 318/626 |
| 5,515,898 | 5/1996 | Alcocer | 160/84.02 |
| 5,848,634 | 12/1998 | Will et al. | 160/310 |
| 5,889,377 | 3/1999 | Mao | 318/466 |
| 5,907,227 | 5/1999 | Domel et al. | 318/480 |

FOREIGN PATENT DOCUMENTS

| | | |
|---|---|---|
| 1063508 | 1/1976 | Canada . |
| 1109387 | 1/1979 | Canada . |
| 2150911 | 6/1994 | Canada . |
| 2149304 | 3/1995 | Canada . |

*Primary Examiner*—Brian Sircus
*Attorney, Agent, or Firm*—Gowling, Strathy & Henderson; D. Doak Horne

[57] ABSTRACT

A drapery actuator to open and close draperies, comprising a housing and a drive pulley supported by the housing to engage a drapery cord coupled to a drape. A motor, typically a D.C. motor, is supported by the housing for providing torque to reversibly rotate the drive pulley to move the drapery cord between a first extreme (typically closed) position and a second extreme (typically open) position. A first electrical switch operatively connected to the motor functions as a cut-out switch and reversing switch to stop the motor from continued turning in a given direction and thereafter switching polarity, to allow the motor to turn in an opposite direction when the switch is re-activated. A torque-activated mechanism is provided, adapted to actuate the first electrical switch when the drive pulley moves the drapery cord to the first position, and is further adapted to actuate the first electrical switch when the drive pulley is reversibly rotated by the motor to move the drapery cord to the second position.

19 Claims, 23 Drawing Sheets

DRAPERY ACTUATOR

This application is a continuation-in-part of U.S. patent application Ser. No. 08/703,760 filed Aug. 27, 1996.

FIELD OF INVENTION

The present invention relates to a drapery actuator and, more particularly, relates to a motorized drapery actuator for opening and closing draperies and the like.

BACKGROUND OF THE INVENTION

Ordinarily, to open draperies, the draperies are manually moved along a drapery cord between open and closed positions. This, of course, effectively regulates the amount of light entering a room.

It is often desirable to have motorized drapery actuators to open and close draperies. Such drapery actuators have a drive pulley to engage a drapery cord which engages draperies and the like. Actuation of the drive pulley opens and closes the draperies. There must be proper tension on the drapery cord to enable the drive pulley to effectively move the drapery cord.

Such drapery actuators are mounted on a wall to enable the drive pulleys to engage the drapery cord to open and close the draperies.

Actuators which are operated by wireless remote control are known. For example, U.S. Pat. No. 4,958,112 which issued Sep. 18, 1990, to Zerillo discloses a drapery actuator. A pull cord is affixed to a drapery rod, which has drapes mounted thereon, to form a bight with vertical and parallel reaches. The drapery actuator has a pair of limit switches in the form of single pole, single-throw normally open reed switches to variably regulate the open and closed positions of the drapes. These switches are actuated by drapery actuators which are magnets affixed to the reaches at positions corresponding to the open and closed positions of the drapes. When a magnet is in actuation position with a limit switch, the switch closes completing the electrical circuit. When a magnet moves away from a switch, the switch will return to an open position preventing electricity from passing beyond the switch. The magnets are manually adjusted along the reaches to correspond to the desired open and closed positions of the drapes. As the drapes are opened and closed, the pull cord may stretch due to wear on the pull cord causing the pull cord to slacken slightly. The magnets will then have to be manually adjusted along the reaches for opening and closing of the drapes. The positioning of the magnets on the vertical reaches to open and close the switches is limited to the length of the vertical reaches. Since the open and closed positions of the drapes are regulated by the magnets, those positions are also limited by the lengths of the reaches. The length of the reaches must be at least as long as the drapery rod and the width of the drapes on the drapery rod or the magnets will engage the switches in a position where the drapes are not fully open or fully closed. Thus, this device would not be suitable for long drapery rods, i.e. wide windows or wall coverings, where the room has a low ceiling since the vertical reaches would be shorter in length than the length of the drapery rod causing the magnets to engage the switches when the drapes are not fully open or fully closed.

U.S. Pat. No. 4,914,360 which issued Apr. 3, 1990 to Hsieh et al. discloses a venetian blind controller for controlling the opening and closing of a vertical venetian blind and for controlling the angular position of the blades by means of two separate motors, each motor having an electromagnetic clutch means to allow manual operation in the event of a power failure.

U.S. Pat. No. 3,117,767 which issued Jan. 14, 1974 to McLean et al. discloses a motorized drapery puller having a casing which supports a motor driven pulley. The casing and pulley are slidably positionable within a bracket to allow variable positioning of the pulley to engage a drapery cord.

It is desirable to have a motorized drapery actuator which does not frequently require manual adjustment of actuators to regulate the open and closed positions of the draperies and which may be used to regulate open and closed positions of draperies for different widths of windows and wall coverings.

SUMMARY OF THE INVENTION

Accordingly, in order to substantially overcome or mitigate at least one of the disadvantages of the prior art, the present invention provides for a drapery actuator which has a torque-activated switch means to provide for automatic shut off of the drapery actuator motor when the drapery cord is in either of two extreme positions (i.e., open or shut).

In one broad aspect of the present invention, a drapery actuator to open and close a drape is provided. As used herein and claimed, the term "drape", "draperies", and/or "drapes" are intended to include curtains, vertical blinds, and any other wall or window covering or divider which is moveable between positions, typically open and closed position, by a drapery cord. A housing and drive pulley, supported by the housing, are provided, the latter being adapted to engage a drapery cord operatively coupled to the drape. A motor is provided to provide torque for reversibly rotating the drive pulley so as to move the drapery cord in a first direction to a first position, and to move the drapery cord in a second opposite direction to a second position. A first switch is provided, operatively connected to the motor. A torque-activated switch means is provided, adapted to actuate the first electrical switch when the drive pulley moves the drapery cord to the first position, and further adapted to activate the first electrical switch when the drive pulley is reversibly rotated by the motor to move the drapery cord to the second position, so as to cause the first electrical switch to deactivate the motor when the drapery cord is moved to the first position thereby preventing further movement, and to cause the first electrical switch to deactivate the motor when the drapery cord is moved to the second position, thereby preventing further movement of the drapery cord in the second opposite direction.

In a first preferred embodiment, the torque-activated switch means comprises a clutch means having a first clutch plate and a second clutch plate, wherein the second clutch plate may be moved to a slipping position for slipping engagement with the first clutch plate and for simultaneous activation of the first electrical switch. In this embodiment, the second clutch plate is moveable in a lateral (i.e., axial) direction from the first engaged position to the slipping position where it contacts the first electrical switch to interrupt electrical current to the motor. The second clutch plate moves from the first engaged position to the slipping position upon the torque transmitted to the clutch plate reaching an upper limit. More particularly, it is contemplated in a further preferred embodiment that the ease of movement of the second clutch plate from the first engaged position to the slipping position is adjustably pre-selectable. Such may be done, for example, by use of an adjustable spring which adjustably biases the first clutch plate in contact with the second clutch plate. Advantageously, such feature allows the drapery actuator to be used with drapes of various lengths which will have different torques necessary to open and close them. For example, a short, light drape may need only a low torque transmitting capability to the drive pulley, to allow the clutch to slip and the motor to be shut off upon the drape reaching, for example, a fully closed position. However, the readjustable feature ensures that the clutch may be adjusted to permit more torque to be transmitted where the drapes are unusually long and/or heavy, and the threshold of torque transmission is necessarily higher to allow greater amount of torque to be transmitted before the actuator "trips" at the extremity (fully open or fully closed position).

In a preferred embodiment, the first electric switch is of a design so that when actuated such switch interrupts electrical current flow to the motor, and reverses such electrical current, so that upon re-activation such first electrical switch will permit current to flow to the motor causing it, and the drive pulley to which it is operatively coupled, to turn in an opposite direction. In the preferred embodiment, for ease in design of the switch to the permit reversal of the electrical current, the motor is a direct current motor.

In another alternative embodiment of the inventions, the torque-activated switch means comprises a first electronic circuit for monitoring quantum of current flowing into the motor and the first electric switch is a second electronic circuit for detecting when such current flow exceeds a predetermined threshold and thereafter deactivating the motor so as to preventing it from continuing to turn in the direction which it was activated to turn. In a preferred embodiment of the invention, the second electronic circuit comprises a means to vary such threshold. Advantageously, such means to provide variation of the threshold of current necessary to "trip" the motor allows the draper actuator to be used with various lengths (and weights of drapes), and is analogous to the pre-selectable adjustable spring described above in respect of another embodiment.

In another broad aspect, a drapery actuator in accordance with the present invention comprises a housing and a drive pulley supported by the housing to engage a drapery cord which is attached in some manner to a drape. A motor is supported by the housing for reversibly rotating the drive pulley when desired to move the drapery cord between a first position and a second position, which when said drapery cord is in such first position the curtain is typically fully open, and when the drapery cord is in such second position, the drape is typically fully closed. First and second electrical switches are operatively connected to the motor. A torque activated switch means cooperates with the drive pulley such that the first electrical switch is actuated to deactivate the motor when the first drive pulley moves the drapery cord to the first position, when the drape is open and the second electrical switch is actuated to deactivate the motor when the drive pulley is reversibly rotated by the motor to move the drapery cord to the second position, when the drape is typically in the fully closed position. The motor allows the drape to be moved to extreme open, extreme closed or intermediate positions. The torque activated switch means provides automatic shut-off of the motor at the extreme open and extreme closed positions but the drapes can be positioned at intermediate positions.

In particular, the torque-activated switch means is adapted to activate the first electrical switch when the drive pulley moves the drapery cord in a first direction to the first position, wherein the drape is typically in the fully open position, so as to cause the first electrical switch to deactivate the motor and prevent further movement of the drapery cord in such first direction. The torque-activated switch means is further adapted to activate the second electrical switch when the motor is reversed and the drive pulley moves the drapery cord in a second opposite direction to the second position in which the drape is typically in the fully closed position, so as to cause the second electrical switch to deactivate the motor and prevent further movement of the drapery cord in the second direction. Accordingly, in a broad aspect of the present invention, a drapery actuator to open and close a drape is provided, comprising a housing and a drive pulley supported by the housing. The drive pulley is adapted to engage a drapery cord. A motor is provided to provide torque for reversibly rotating the drive pulley so as to move the drapery cord in a first direction to a first position, and to move the drapery cord in a second opposite direction to a second position. First and second electrical switches, operatively connected to the motor, are provided. Torque-activated switch means are provided to actuate the first and second electrical switches, and in particular such switch means is adapted to actuate the first electrical switch when the drive pulley moves the drapery cord to the first position, and is further adapted to activate the second electrical switch when the drive pulley is reversibly rotated by the motor to move the drapery cord to the second position, so as to cause the first electrical switch to deactivate the motor when the drapery cord is moved to the first position thereby preventing further movement of the drapery cord in the first direction, and to cause the second electrical switch to deactivate the motor when the drapery cord is moved to the second position thereby preventing further movement of the drapery cord in the second direction. The torque-activated switch means in this embodiment is an actuator arm which is pivotable between a position where it actuates the first electrical switch and a position where it actuates the second electrical switch.

Typically, drapes in the form of a pair of vertical drapes which separate from each other to allow sunlight to pass through a window, when at a fully open position cannot be opened further due to each drape reach; the end of the curtain rod. Likewise when the drapes are in the fully closed position they cannot be further closed due to the respective pairs abutting each other. These serve as drape movement limiting means. The torque necessary to be supplied by the motor to continue to move the drapery cord is essentially an infinite amount of torque at these two extreme positions, since no further movement of the drape once in the first (open) position or in the second (closed) position can occur. Accordingly, in operation, in the preferred embodiment of this latter embodiment, the actuator arm pivots between the first position and the second position upon the torque provided by the motor to the drive pulley exceeding a pre-defined limit, which in a further preferred embodiment may be adjustably preselected by varying rotational friction which occurs between the actuator arm and the housing when the motor is actuated. The drape movement limiting means causes the torque provided by the motor to the drive pulley to reach the upper pre-defined limit upon the drapery cord being moved to each of the first and second positions.

Preferably, in all the embodiment of the invention above-described the drapery actuator includes means for varying the mounted position of the housing relative to a support surface to allow adjustment of the tension on the drapery cord. In a preferred embodiment such means comprises the support surface having a plurality of linearly spaced apertures to allow adjustable positioning of housing in this selected one of said apertures.

Also preferably, the housing includes means for varying the position of the housing on the means for attaching the drapery actuator to the support surface to further vary the tension on the drapery cord. In the preferred embodiment such means comprises a helical thread, which upon turning of helical thread allows movement of the housing relative to the support surface.

Also preferably, a receiver circuit and a remote controller are provided to provide remote control of the drapery actuator.

BRIEF DESCRIPTION OF THE DRAWINGS

Embodiments of the present invention will now be described, by way of example only, with reference to the attached Figures, wherein.

DETAILED DESCRIPTION OF PREFERRED EMBODIMENTS OF THE INVENTION

Figure 1:
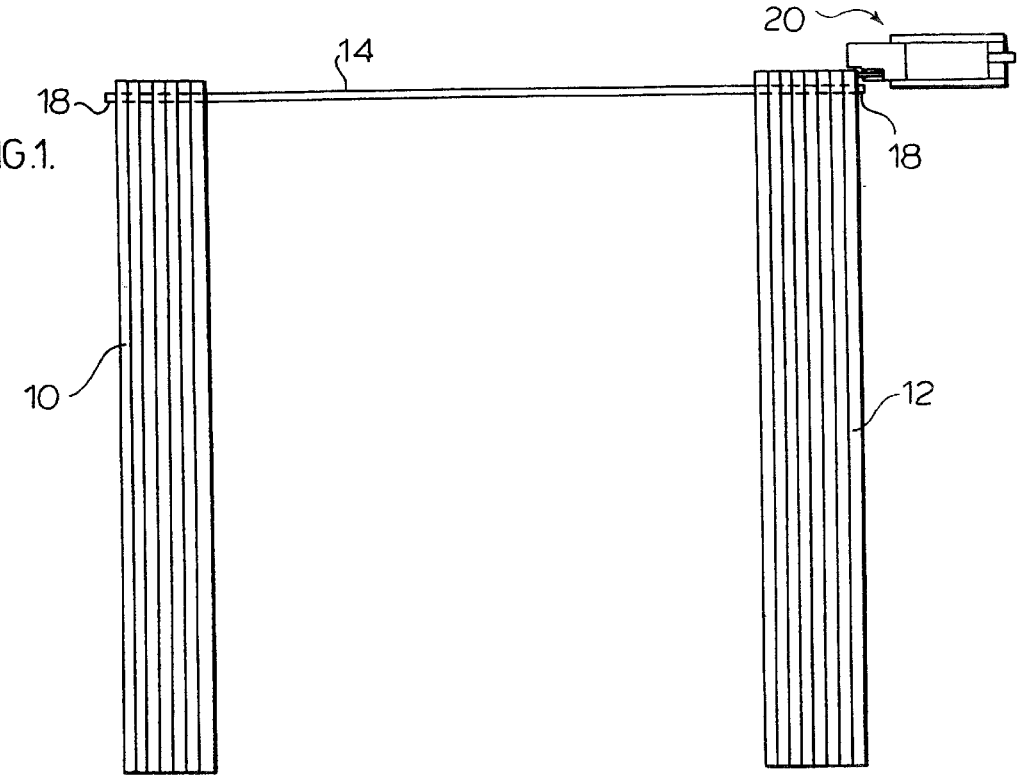
FIG. 1 is a front view of a drapery actuator, in accordance with an embodiment of the present invention, mounted on a wall and engaging a drapery cord having draperies in an open position.
Figure 2:
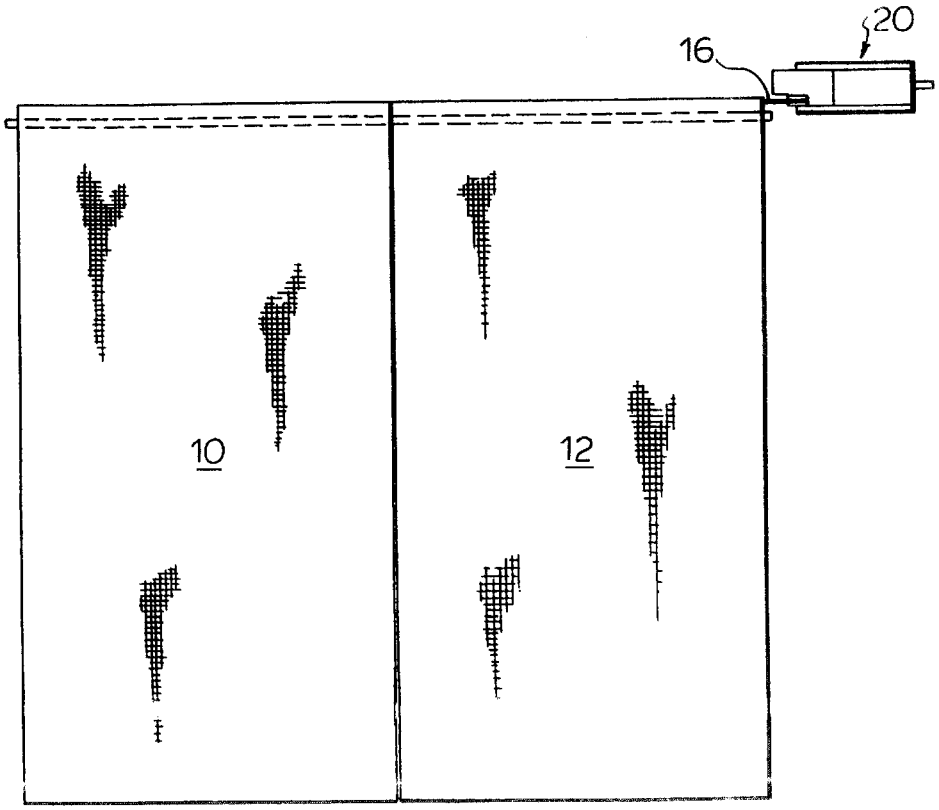
FIG. 2 is a front view of the drapery actuator shown in FIG. 1 with the draperies in a closed position.

Referring first to FIGS. 1 and 2, drapes 10 and 12 are mounted in the usual manner on a curtain rod 14. A drapery cord 16 is disposed above the curtain rod 14 and engages drapes 10 and 12. Drapes 10 and 12 are mounted on the curtain rod 14 proximate a support surface such as a ceiling or a wall 17. Stops 18 are disposed at either end of the curtain rod 14.

A drapery actuator in accordance with the present invention is depicted as numeral 20 in FIGS. 1 and 2. The drapery actuator 20 is attached to the wall 17 proximate the drape 12 and engages the drapery cord 16. The positioning of the drapery actuator 20 is not particularly limited and may be varied depending on the wall space allotted on either side of drapes 10 and 12.

Figure 3:
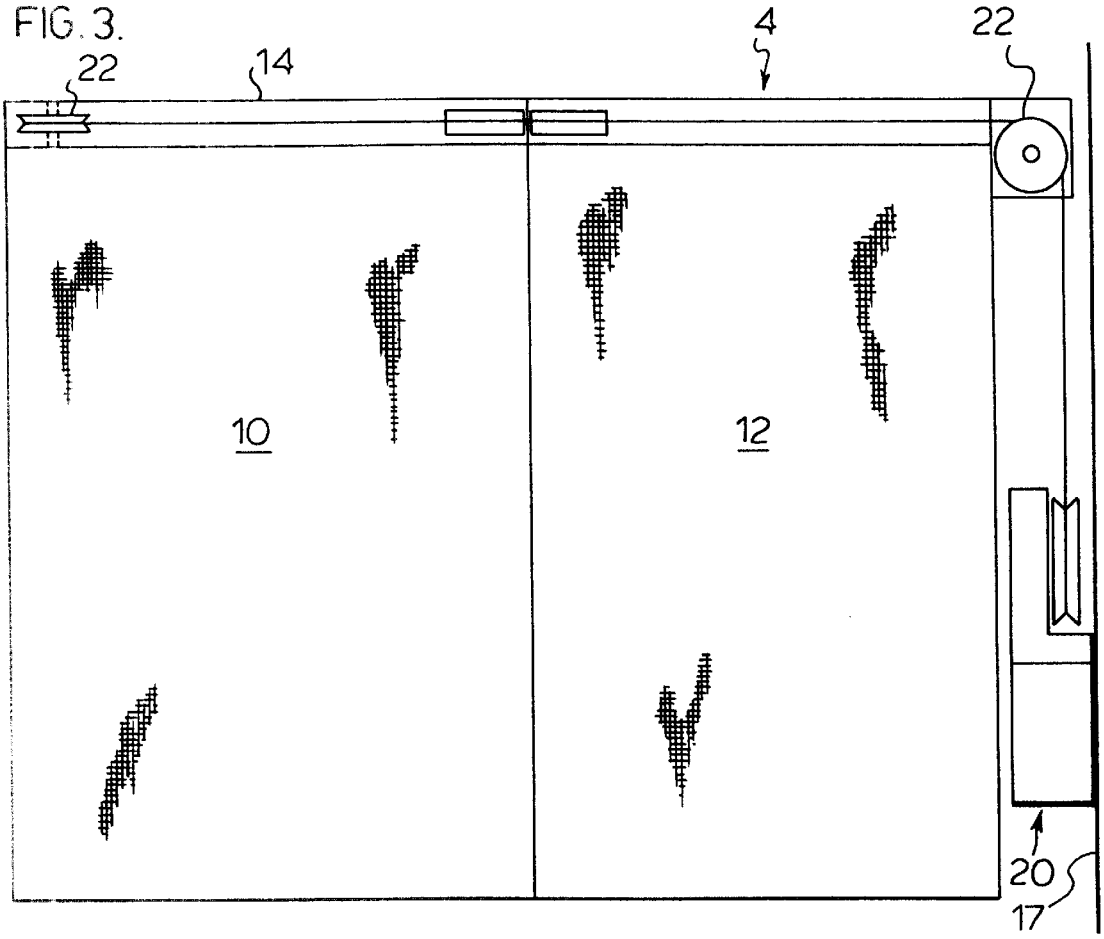
FIG. 3 is a plan view of the drapery actuator shown in FIG. 1 engaging a bight of a drapery cord having draperies in an open position.
Figure 4:
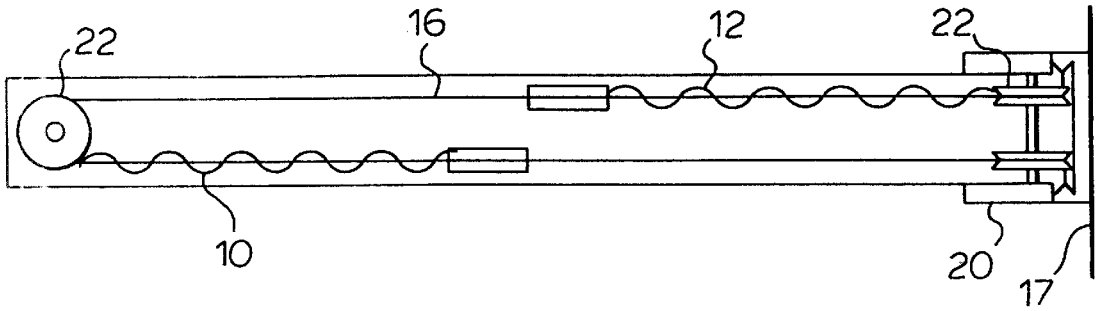
FIG. 4 is a top view of the arrangement of the drapery cord in the direction identified by arrow 4 in FIG. 3.

FIG. 3 shows the drapery actuator 20 mounted in another manner to wall 17. As shown in FIGS. 3 and 4, the drapery cord 16 engages pulleys 22 to form a bight. The drapery actuator 20 then engages the drapery cord 16.

Figure 5:
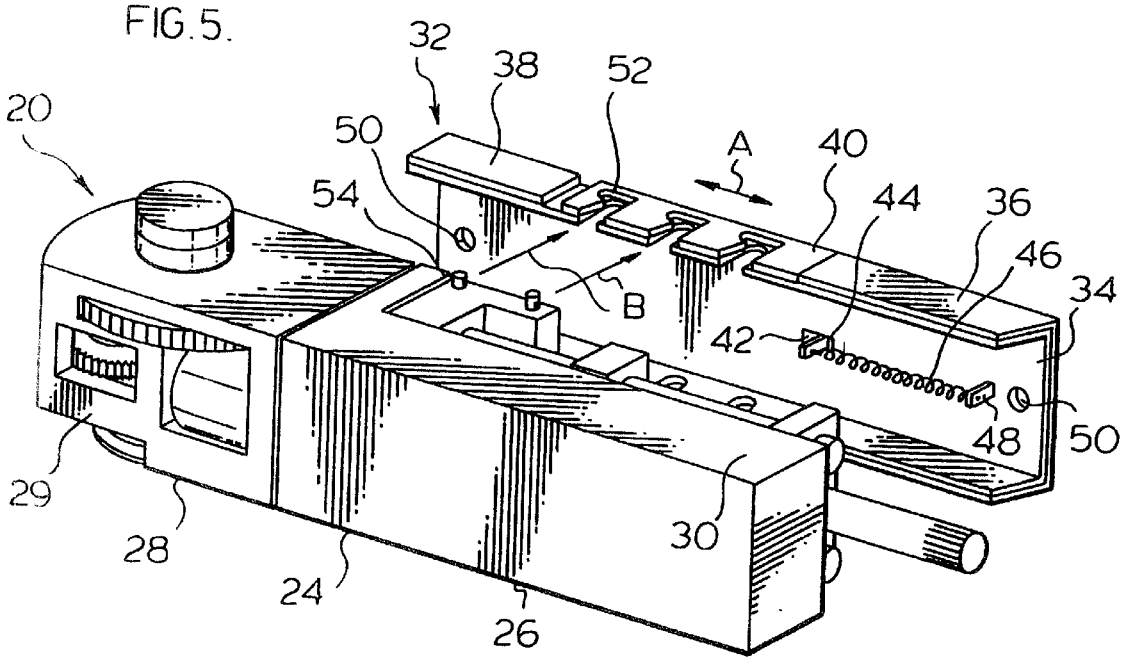
FIG. 5 is a perspective view of the drapery actuator shown in FIG. 1.
Figure 6:
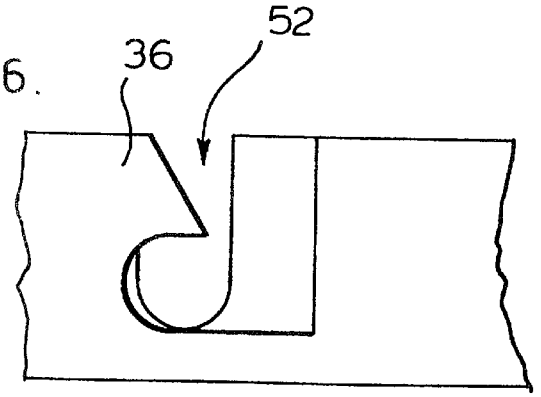
FIG. 6 is an enlarged fragmentary side elevational view of a detent of the mounting bracket of the drapery actuator shown in FIG. 1.

Referring to FIG. 5, the drapery actuator 20 has a substantially rectangular-shaped housing 24 which can be fabricated from any suitable material such as plastic. The housing 24 includes an end section 26 with sides 30 and a front section 28. The front section 28 has a top 29 and a bottom (not shown). The drapery actuator 20 also includes a bracket 32 for mounting the drapery actuator 20 onto the wall 17. The bracket 32 comprises an inner metal member 34 and outer plastic covers 36 and 38. A detent 40 is slidable along the outside of the inner frame member 34 between covers 36 and 38 as shown by arrows A and has a post 42 which passes through a slot 44 in the inner frame member 34.

A compression spring 46 is disposed between the post 42 and another post 48 which is affixed to the inner frame member 34. The compression spring 46 aids in maintaining the detent 40 on the inner frame member 34. As the slidable detent 40 moves between the covers 36 and 38 as shown by arrows A, the post 42 moves in the slot 44. The bracket 32 has holes 50 for attachment of the bracket 32 and, thus, the drapery actuator 20, to the wall 17. Screws (not shown) may be threaded through holes 50 into the wall 17.

The bracket 32 also includes a plurality of slots 52 which receive bosses 54 located on the end section 26, further discussed below, as shown by arrows B. Two bosses 54 are located on each of the sides 30 of the end section 26 and fit within corresponding slots 52 in the bracket 32. As shown in FIG. 5, the detent 40 engages the bosses 54 when they are inserted into the slots 52. This causes the bracket 32 to be locked to the end section 26. It will be understood by those of skill in the art that any number of bosses 54 and slots 52 may be used to join the bracket 32 to the end section 26. Preferably, there are more slots than bosses to allow the bosses and the end section 26 to be placed in different positions on the bracket 32.

Figure 7:
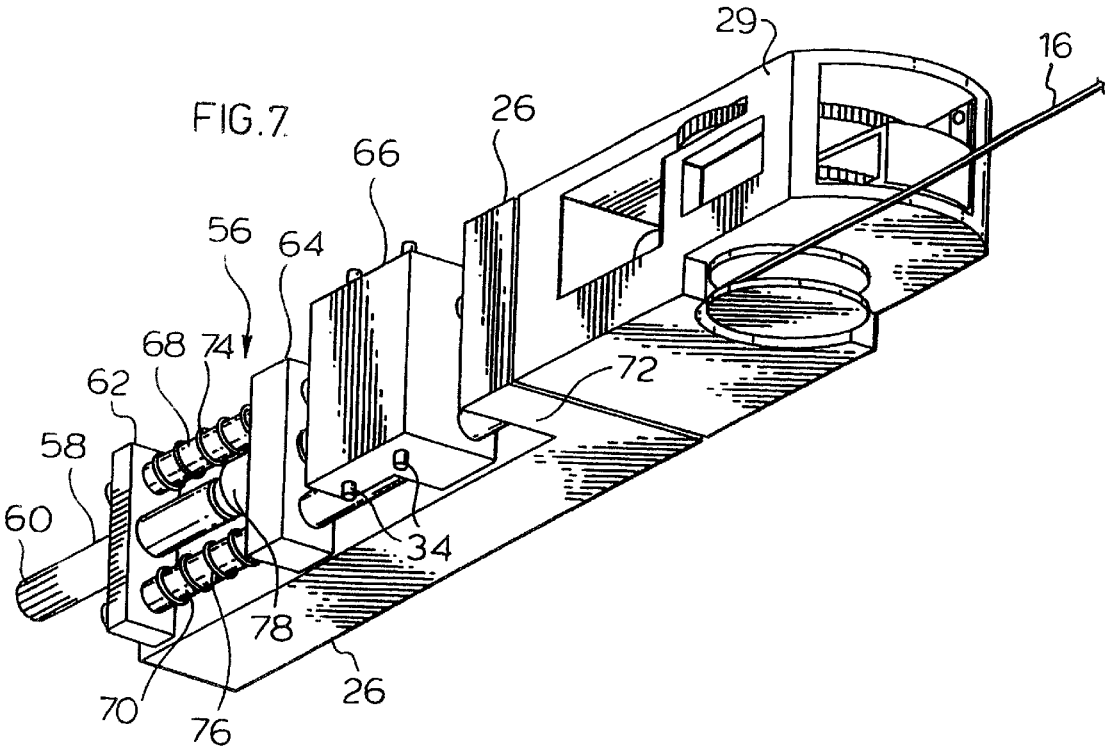
FIG. 7 is a perspective view of the drapery actuator of FIG. 1 with the mounting bracket removed.

Release of the bosses 54 from the slidable detent 40 permits the housing 24 to be removed from the bracket 32 as shown in FIG. 7. FIG. 7 shows a tension maintenance mechanism 56 contained within the end section 26. The tension maintenance mechanism 56 contains a rod 58 which has a serrated end 60. The tension maintenance mechanism 56 also comprises blocks 62 and 64 and L-shaped block 66. The L-shaped block 66 has the bosses 54, discussed above, disposed thereon. The rod 58 passes through block 62 and is threaded into block 64 and abuts block 66.

Block 62 is affixed to rods 68 and 70 which are disposed on either side of the rod 58. The rods 68 and 70 extend through blocks 62, 64 and 66 and are inserted into the wall 72 of the end section 26. The blocks 64 and 66 are slidable along the end section 26. The rods 68 and 70 pass through apertures in block 64, i.e. they are not threaded into block 64. Compression springs 74 and 76 are mounted about rods 68 and 70 respectively to urge block 64 away from block 62. A stop 78 limits the movement of the block 64 on the rod 58.

For operation of the tension maintenance mechanism 56, the bosses 54 are within the slots 52 in the bracket 32 to maintain the housing 24 within the bracket 32. The rod 58 may be rotated clockwise or counterclockwise to move block 64 towards and away from block 62 respectively. At the same time, the block 66 moves towards and away from block 64. As block 64 moves towards block 62 due to the rod 58 being threaded into block 64, the rod 58 pushes block 66 away from block 64 towards the wall 72. Block 66 continues to move towards the wall 72 until the stop 78 abuts block 64. This causes the housing 24 to slide along the bracket 32.

Figure 8:
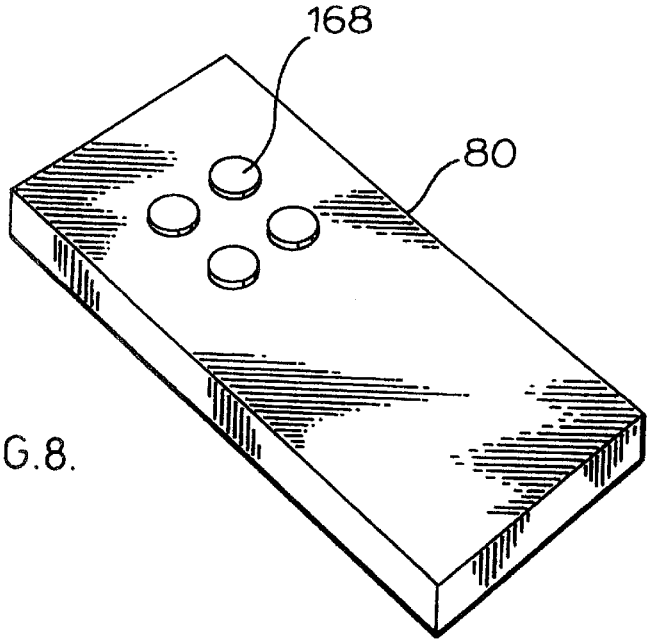
FIG. 8 is a perspective view of a remote controller for the drapery actuator shown in FIG. 1.

The end section 26 contains a receiver circuit actuated by a hand-held wireless remote control transmitter 80 shown in FIG. 8. In the preferred embodiment, radio signals in the microwave frequencies are used by the control units, however, other signals such as ultrasonic, radio and infrared may also be used or the drapery actuator 20 may be hard wired to an appropriate switch box, not shown.

Figure 9:
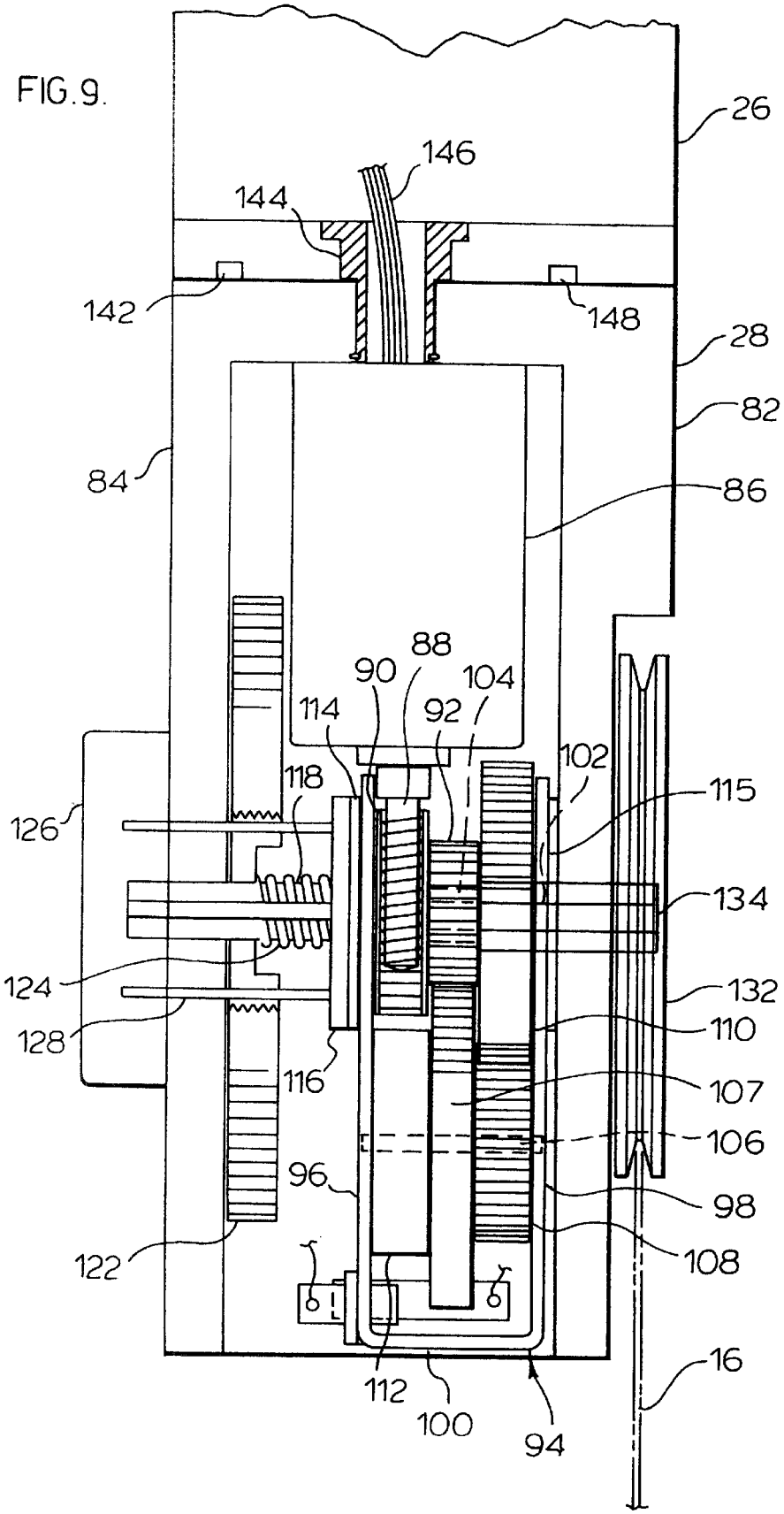
FIG. 9 is a fragmentary top plan view of the drapery actuator of FIG. 1.
Figure 10:
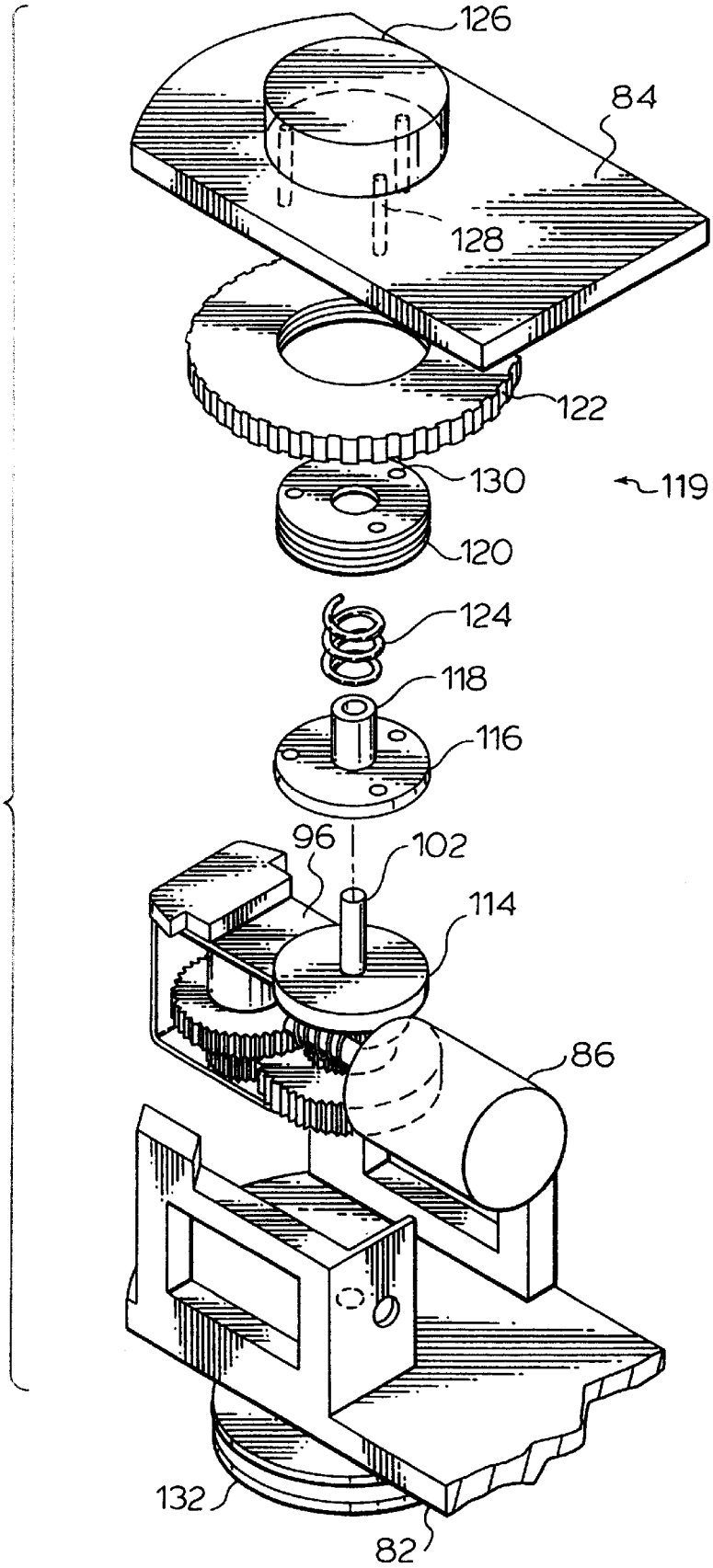
FIG. 10 is a fragmentary exploded perspective view of the adjustable tension limiting means of the drapery actuator shown in FIG. 1.

The front section 28 will now be described in detail with reference to FIGS. 9 and 10. The front section 28 has sides 82 and 84. A reversible motor 86 is located within the front section 28 proximate the end section 26. In this embodiment, the motor 86 is a DC motor but it may be any suitable motor as will occur to those of skill in the art. An appropriate electrical adapter (not shown) is used to connect the drapery actuator 20 to a common AC outlet. Batteries may also be used to provide power to the motor 86.

A worm gear 88 extends from the motor 86 and engages a gear 90. A gear 92 rotates with the gear 90 and has fewer teeth than the gear 90. The gear 90 is proximate an actuator arm 94. The actuator arm 94 is substantially U-shaped and has arms 96 and 98 and a bight 100. The arms 96 and 98 have apertures (not shown) through which a shaft 102 is inserted and which freely rotates within the apertures. The gears 90 and 92 rotate on a collar 104 on the shaft 102 between the arms 96 and 98 of the actuator arm 94. The collar 104 rotates freely on shaft 102.

An axle 106 is disposed between the arms 96 and 98 of the actuator arm 94 and a planetary gear 107 rotates on the axle 106 and engages gear 92. Another planetary gear 108 extends from planetary gear 107 and has fewer teeth than the planetary gear 107. The planetary gear 108 rotates with the planetary gear 107. The planetary gear 108 engages a gear 110 which rotates on the shaft 102. A spacer 112 also extends from the gear 107 and rotates therewith and abuts the arm 96 of the actuator arm 94 to ensure that the gears 107 and 108 are maintained in engagement with the gears 92 and 110 respectively.

A rubber sheath 114 is affixed to the arm 96 between the arm 96 of the actuator arm 94 and a hub 116. The rubber sheath 114 is co-extensive with the hub 116 which is disposed on the shaft 102. Another rubber sheath 115 is affixed to arm 98 of the actuator arm 94. The hub 116 has a hollow shaft 118 which allows the shaft 102 to pass there through as best seen in FIG. 10. The drapery actuator 20 has an adjustable tension limiting means which is depicted generally as 119. The adjustable tension limiting means 119 has an inner wheel 120 within an adjusting wheel 122 which is disposed on the shaft 118. A compression spring 124 is disposed about the shaft 118.

A decorative cover 126 is disposed on the side 84 of the drapery actuator 20 to cover three pins 128. The pins 128 extend from the cover 126 through apertures 130 in the inner wheel 120 and abut the hub 116. The pins 128 are spaced apart from the shaft 118 and are equi-spaced to each other about the circumference of the shaft 118. The pins 128 prevent rotation of the hub 116 with respect to decorative cover 126. The operation of the adjustable tension limiting means 119 is disclosed below. A drive pulley 132 is disposed proximate the sidewall 82 and is affixed to a collar 134. The gear 110 is also affixed to the collar 134 which rotates about the shaft 102. The drapery cord 16 engages the drive pulley 132. As will be apparent to those of skill in the art, drive pulley 132 is sized appropriately for the intended use of drapery actuator 20. For example, if drapery actuator 20 is to be used with vertical blinds, drive pulley 132 can be fabricated with a larger groove as appropriate, or the drive pulley 132 may have a V-shaped groove to enable it to engage various thicknesses of cords.

In a preferred embodiment, the gears of front section 28 are formed of plastic to reduce weight and manufacturing expense. It will be understood that the number of gears may vary. Further, a cover (not shown) may be provided for front section 28 to prevent unintentional access to these gears as an additional safety measure.

Figure 11:
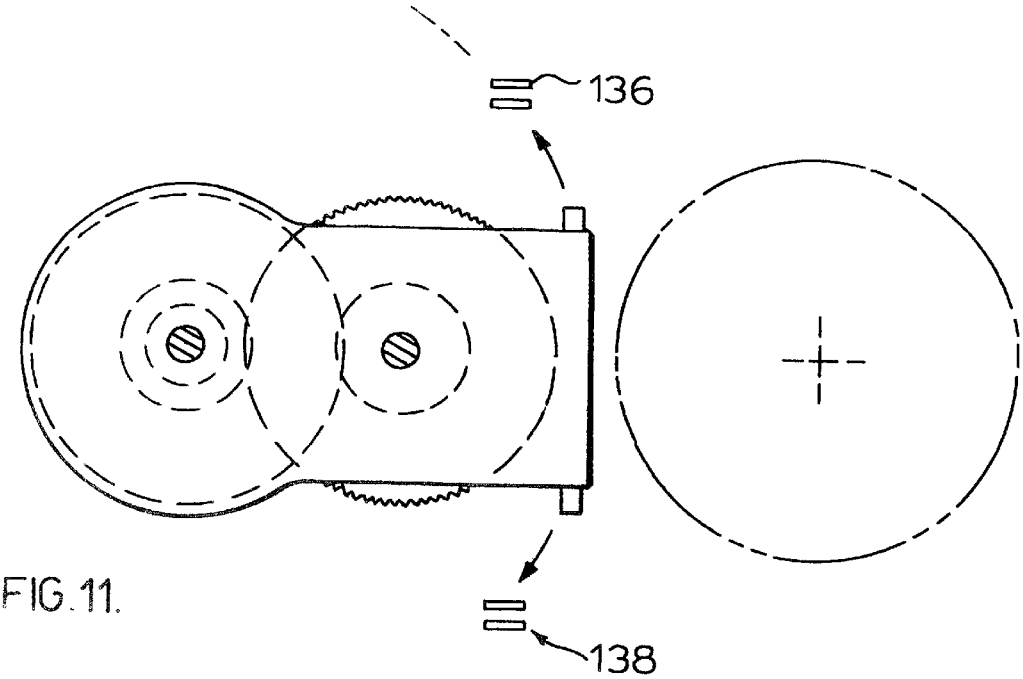
FIG. 11 is a side plan view of the actuator arm between the two electrical switches.
Figure 12:
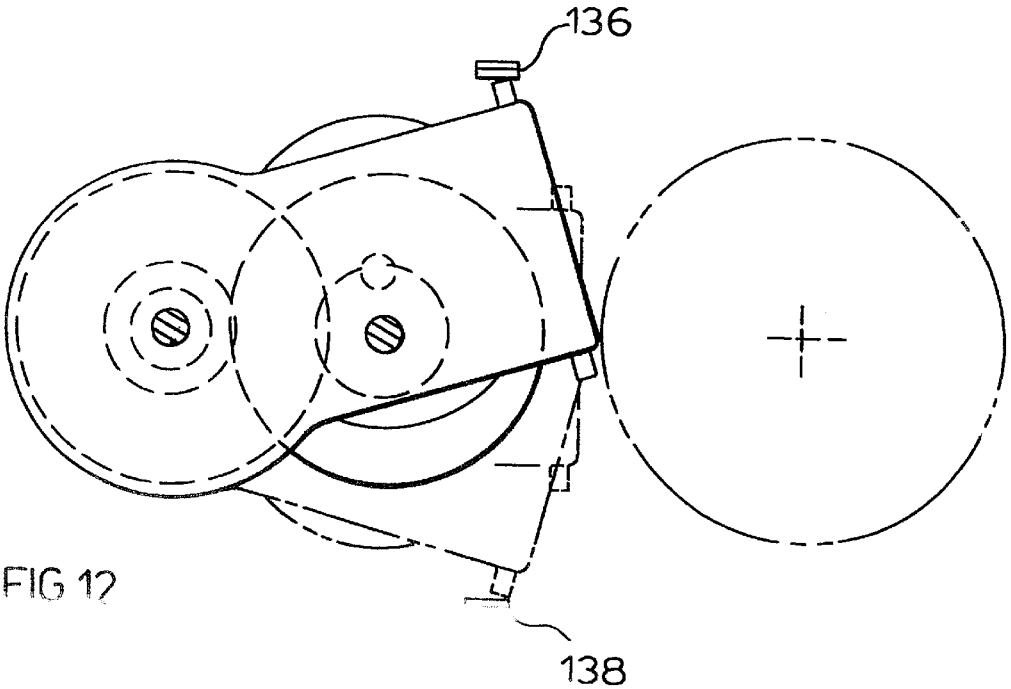
FIG. 12 is a side plan view of the actuator arm in contact with the two electrical switches.

FIGS. 11 shows actuator arm 94 and normally open switches 136 and 138 and FIG. 12 shows actuator arm 94 closing switches 136 and 138 at the respective extremities of its range of pivotal movement.

Figure 13:
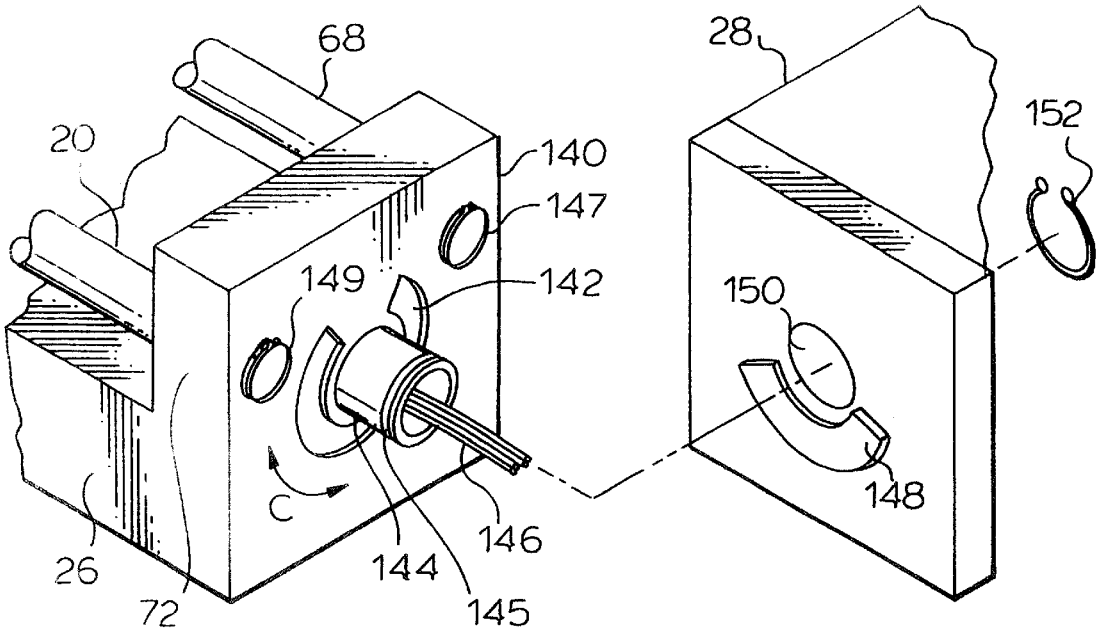
FIG. 13 is a perspective view of the attachment of the end section and the front section of the drapery actuator shown in FIG. 1.
Figure 14:
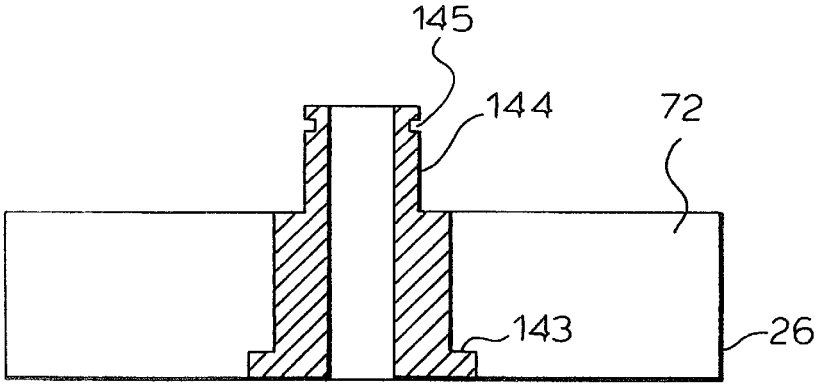
FIG. 14 is a top cross-sectional view of the plug for attachment of the end section and the front section of the drapery actuator shown in FIG. 1.
Figure 15A:
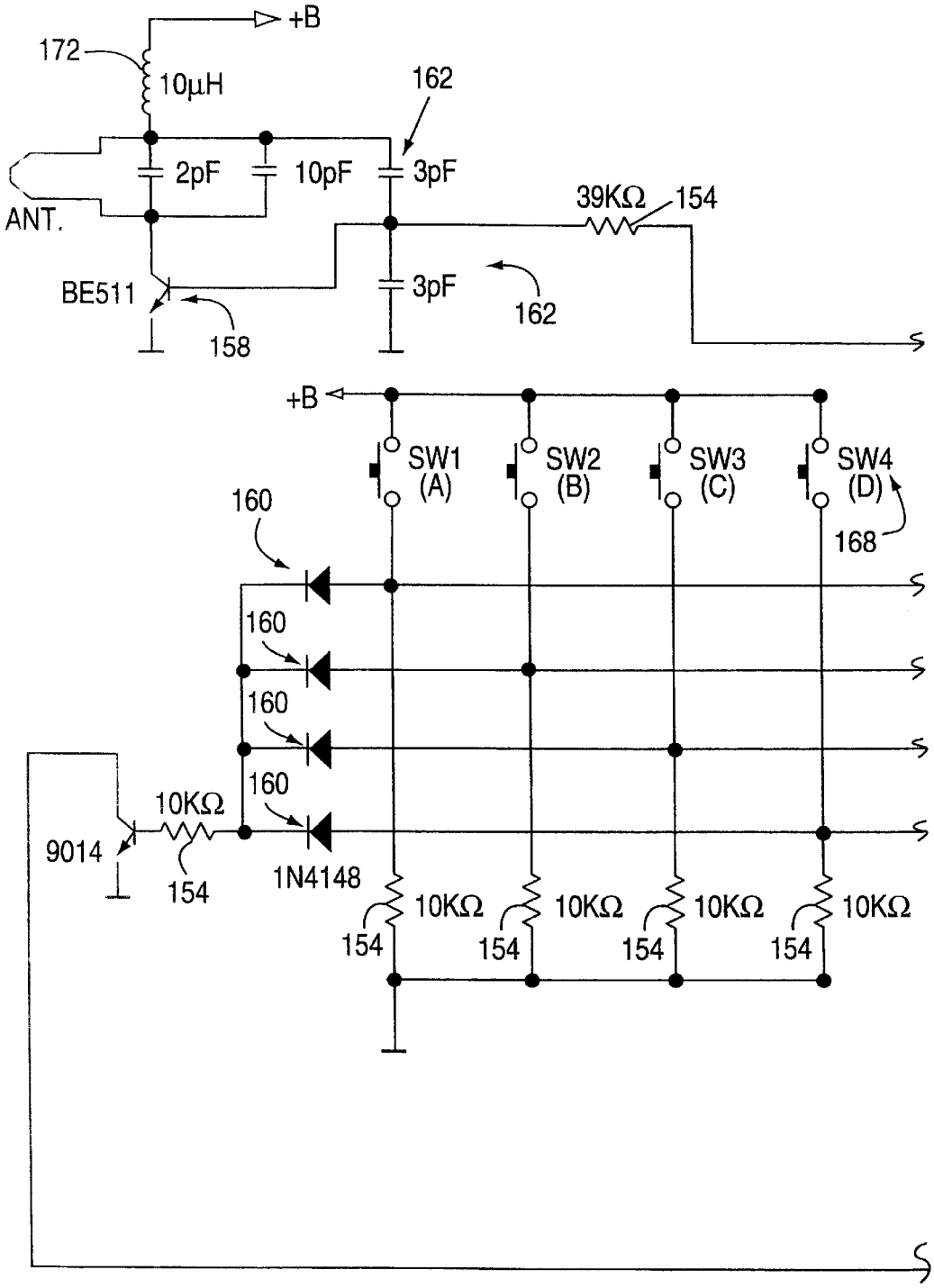
FIGS. 15A and 15B and 16A and 16B are schematic diagrams of the circuitry of the remote controller of FIG. 8.
Figure 15B:
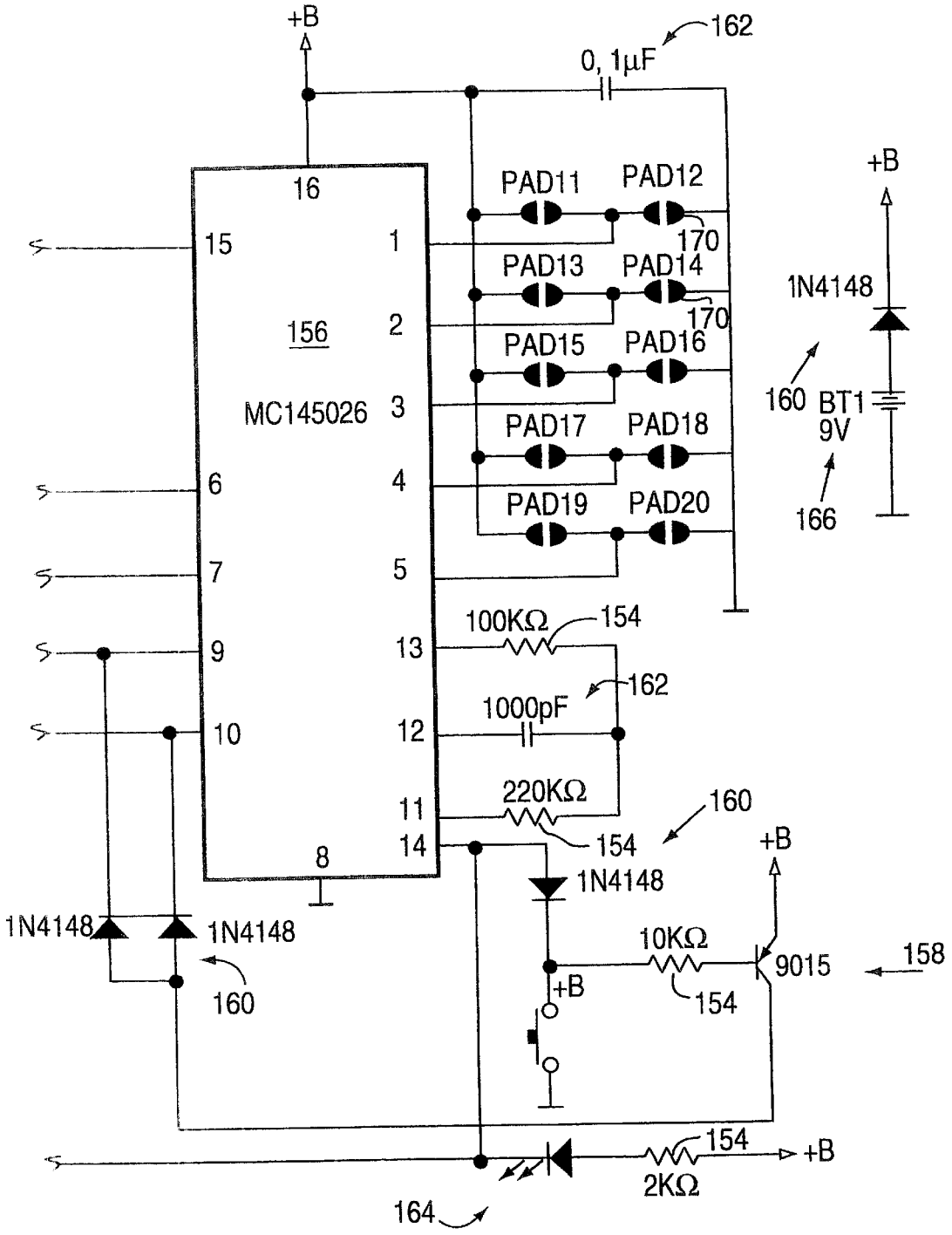
Figure 16A:
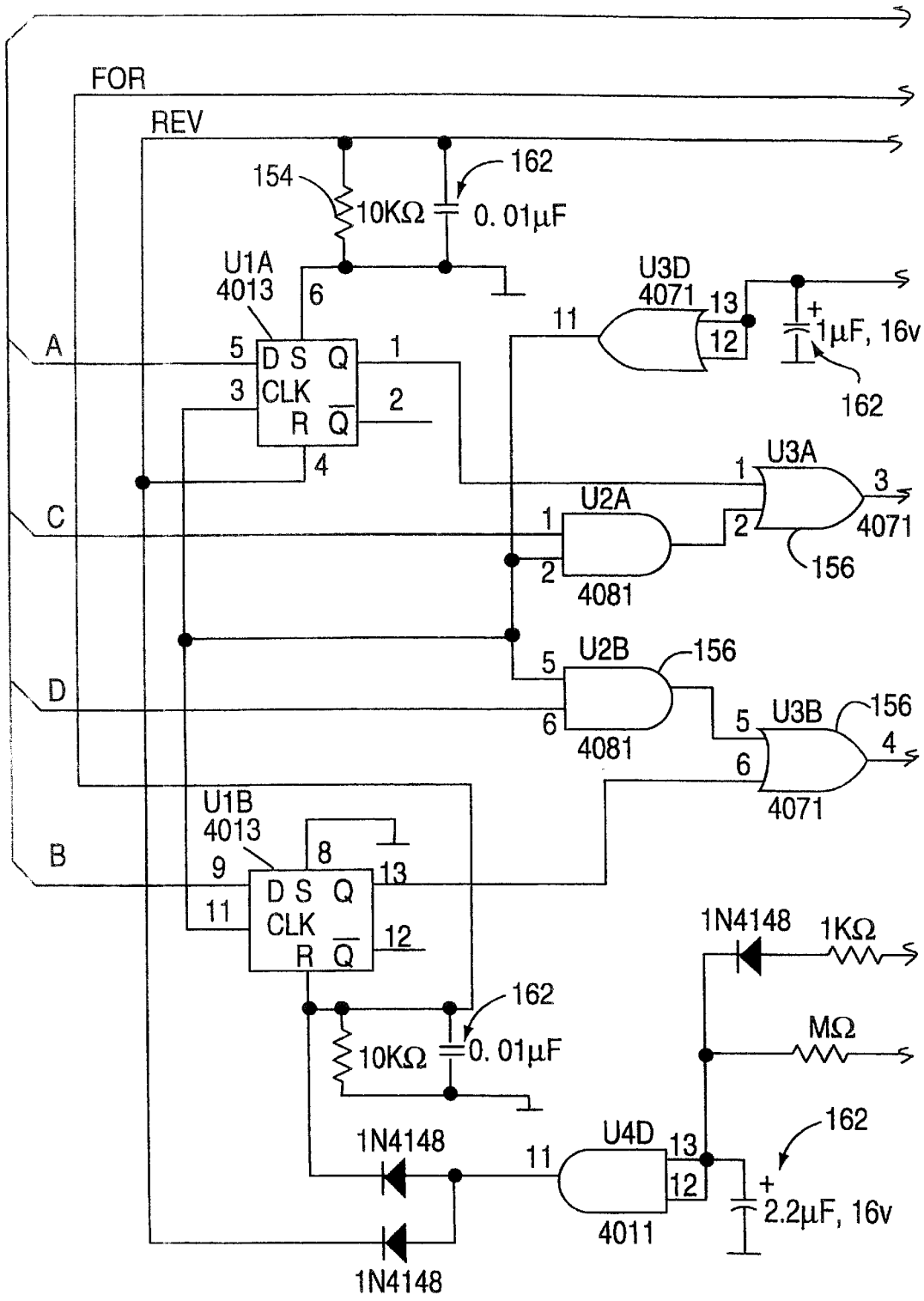
Figure 16B:
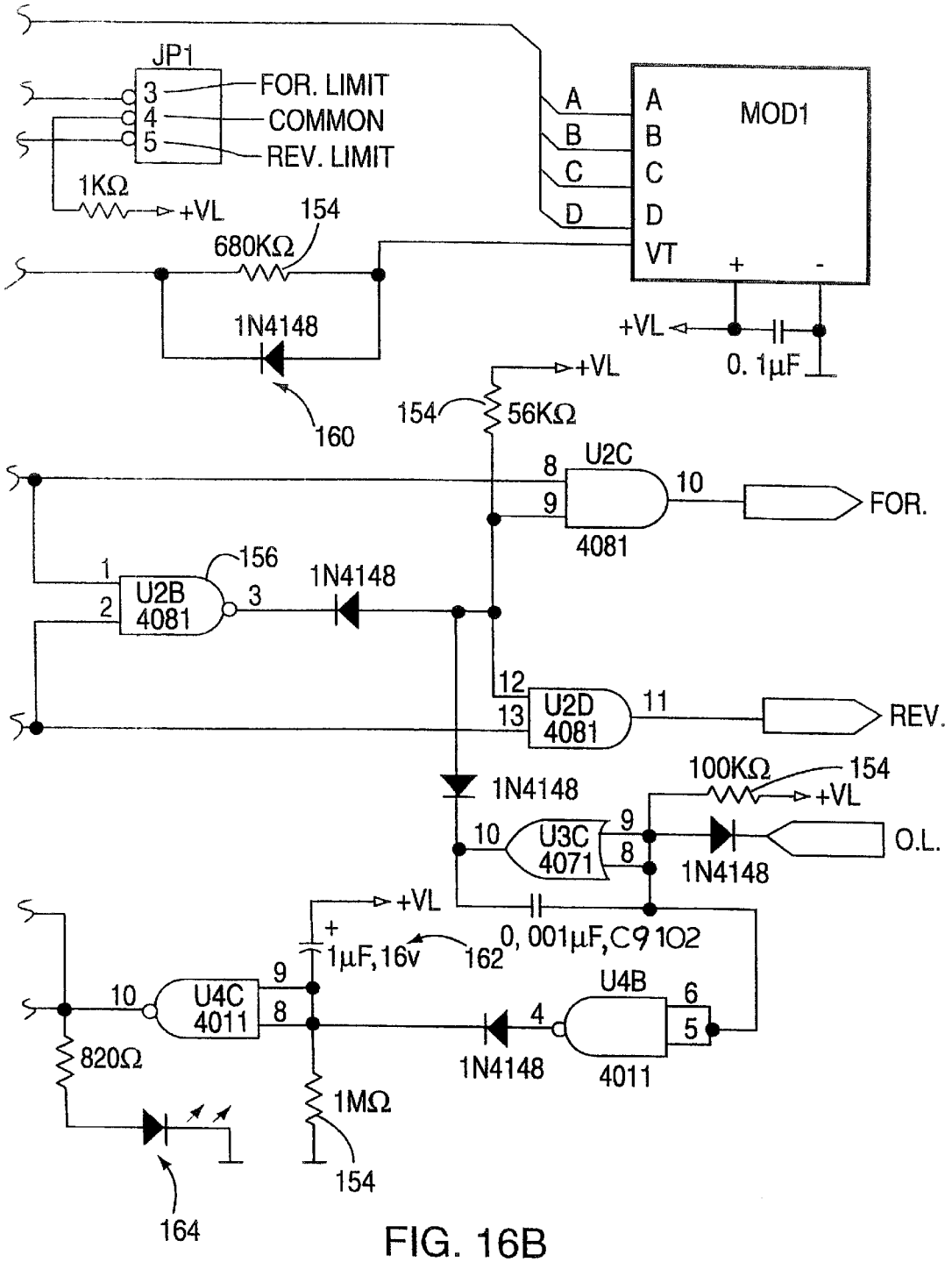
Figure 17A:
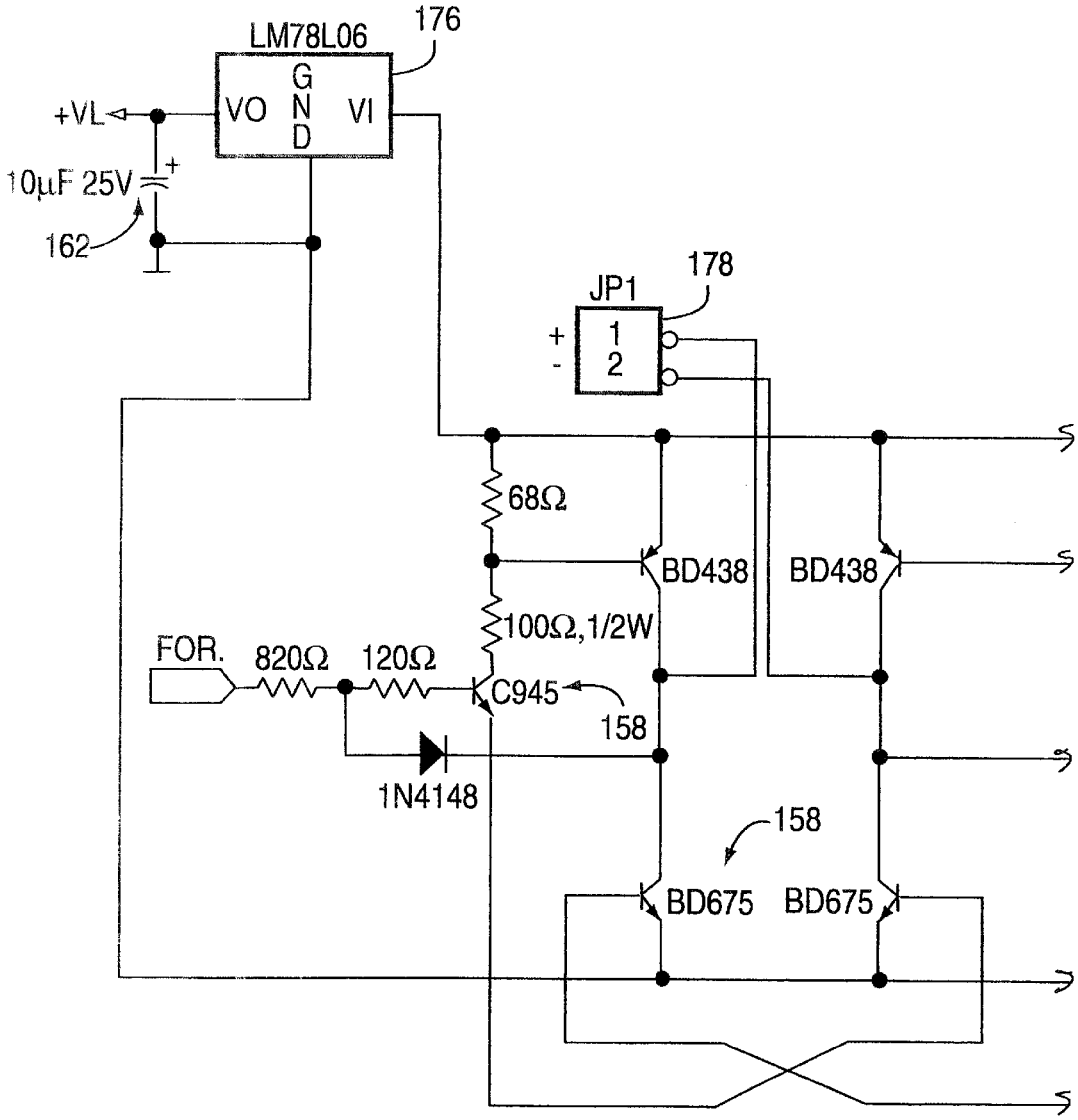
FIGS. 17A and 17B are schematic diagrams showing the power control circuitry of the motor of the drapery actuator.
Figure 17B:
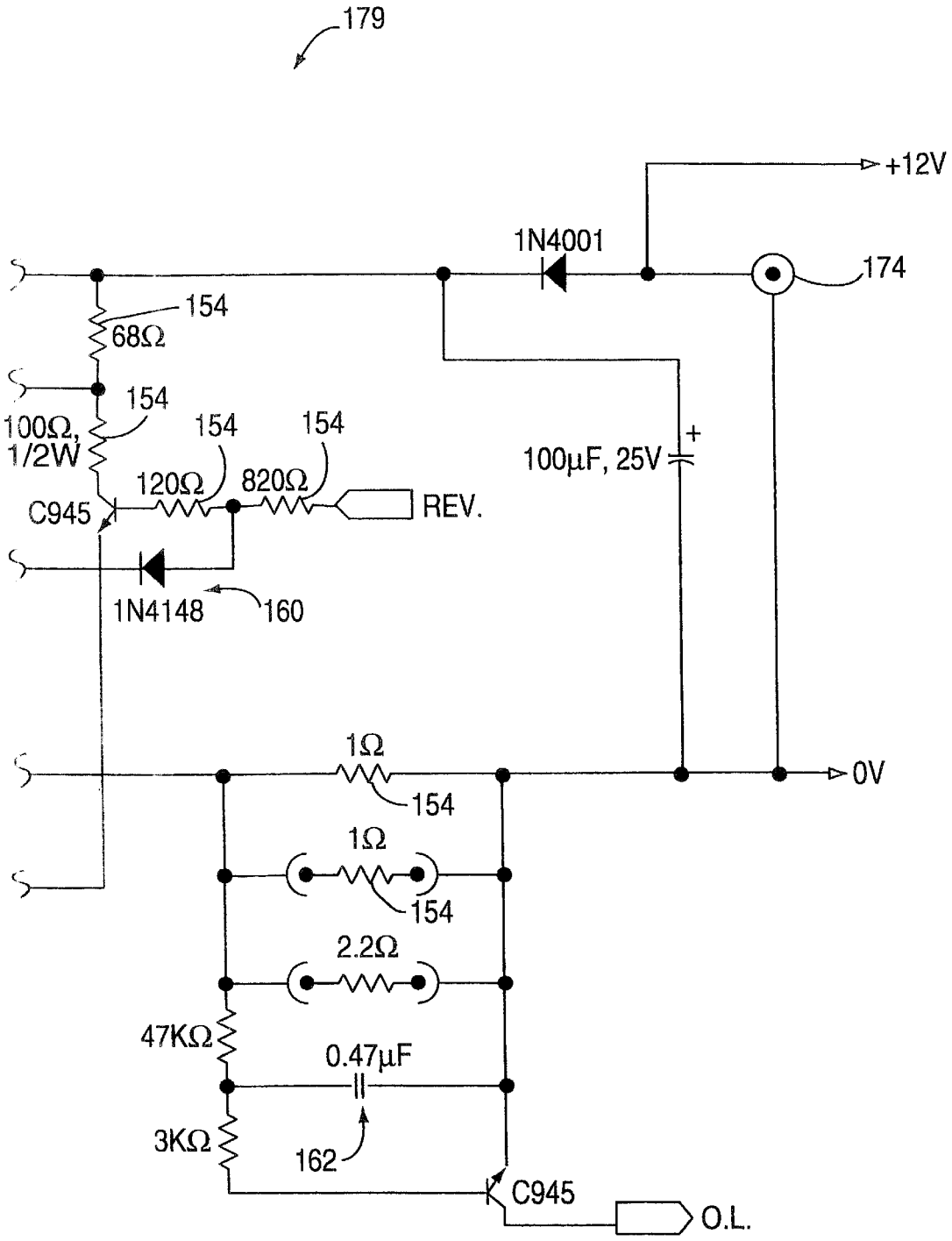
Figure 18A:
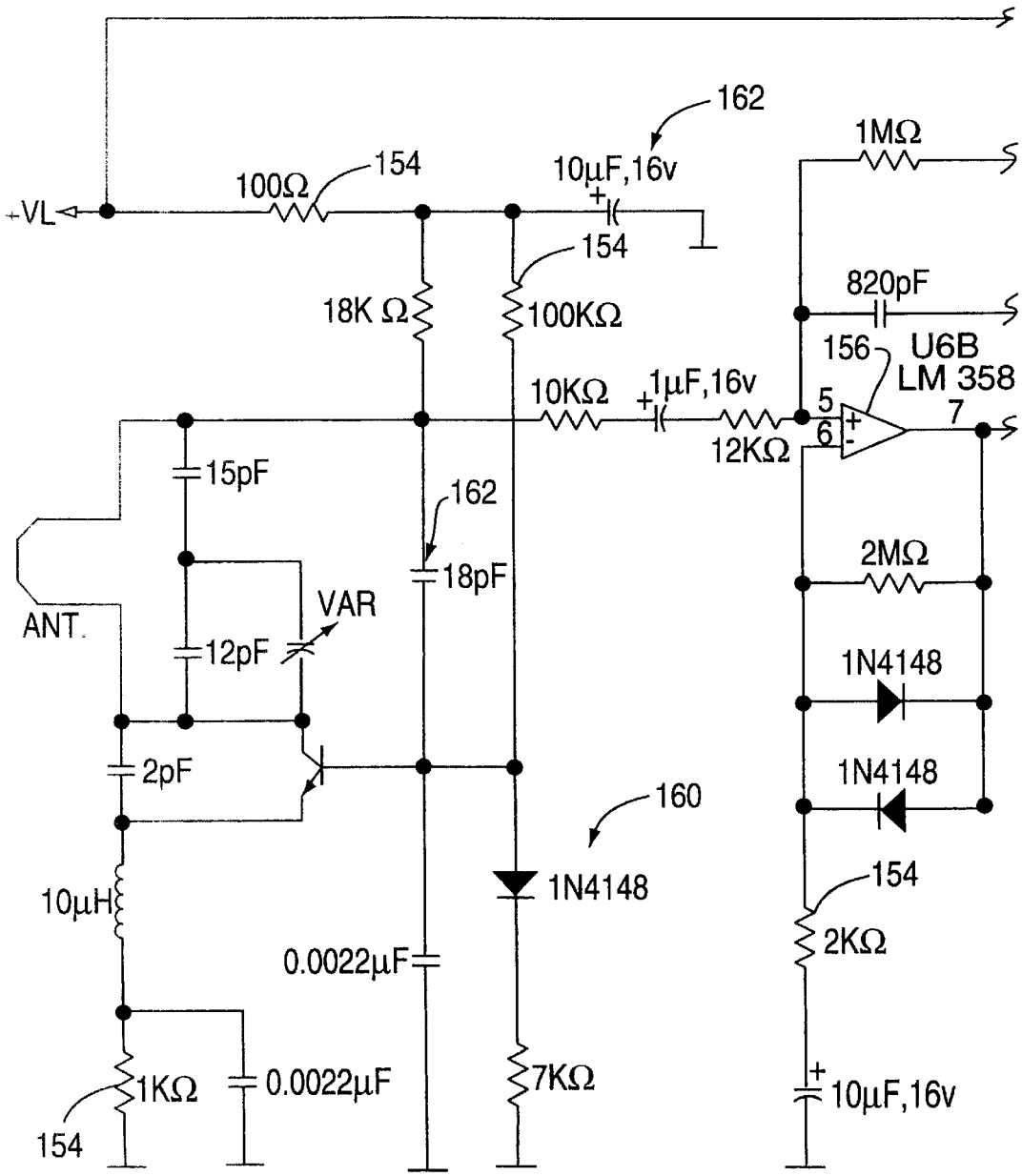
FIGS. 18A and 18B are schematic diagrams of the receiver circuit corresponding to the circuitry of the remote controller shown in FIGS. 15A, 15B and 16A and 16B.
Figure 18B:
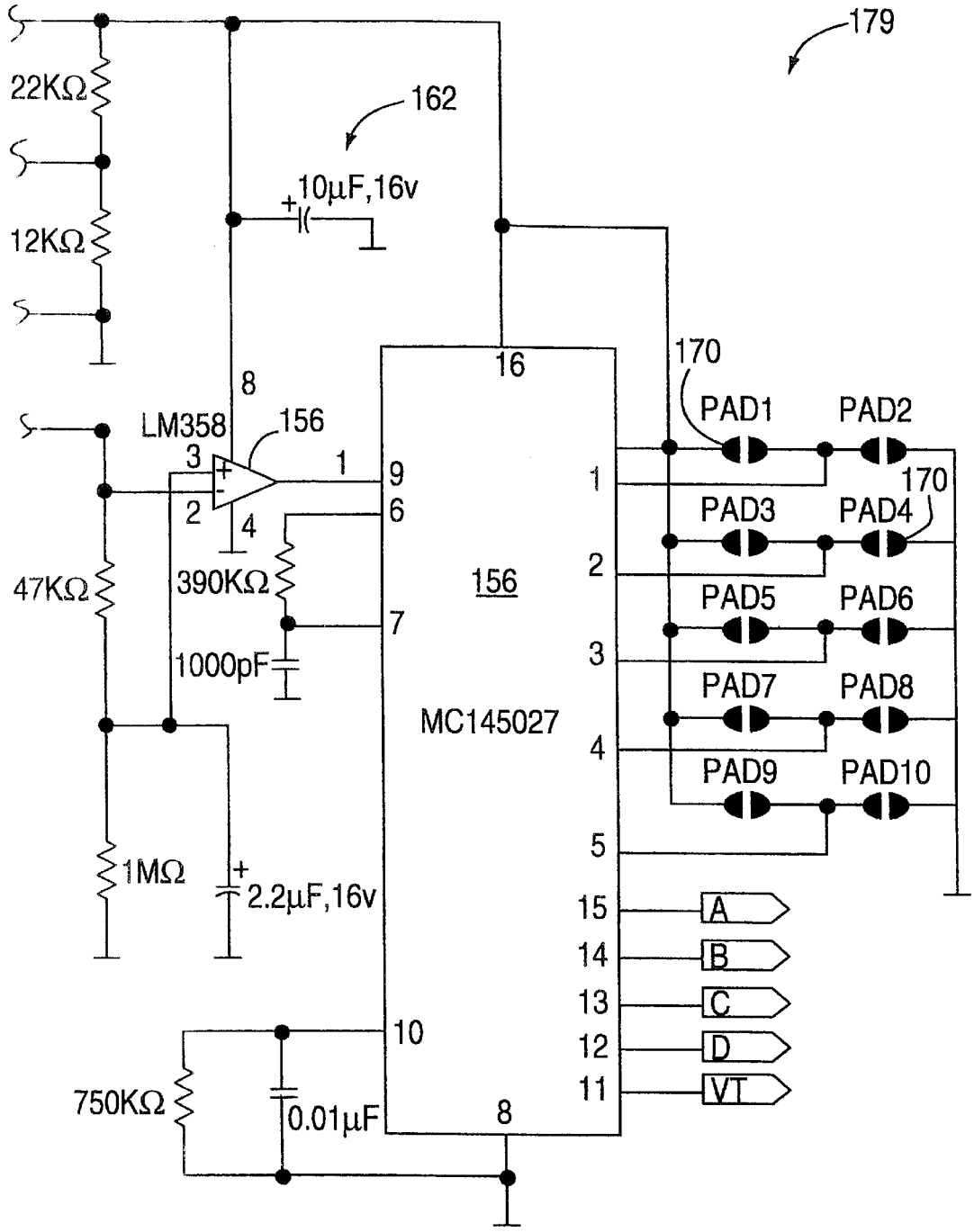
Figure 19:
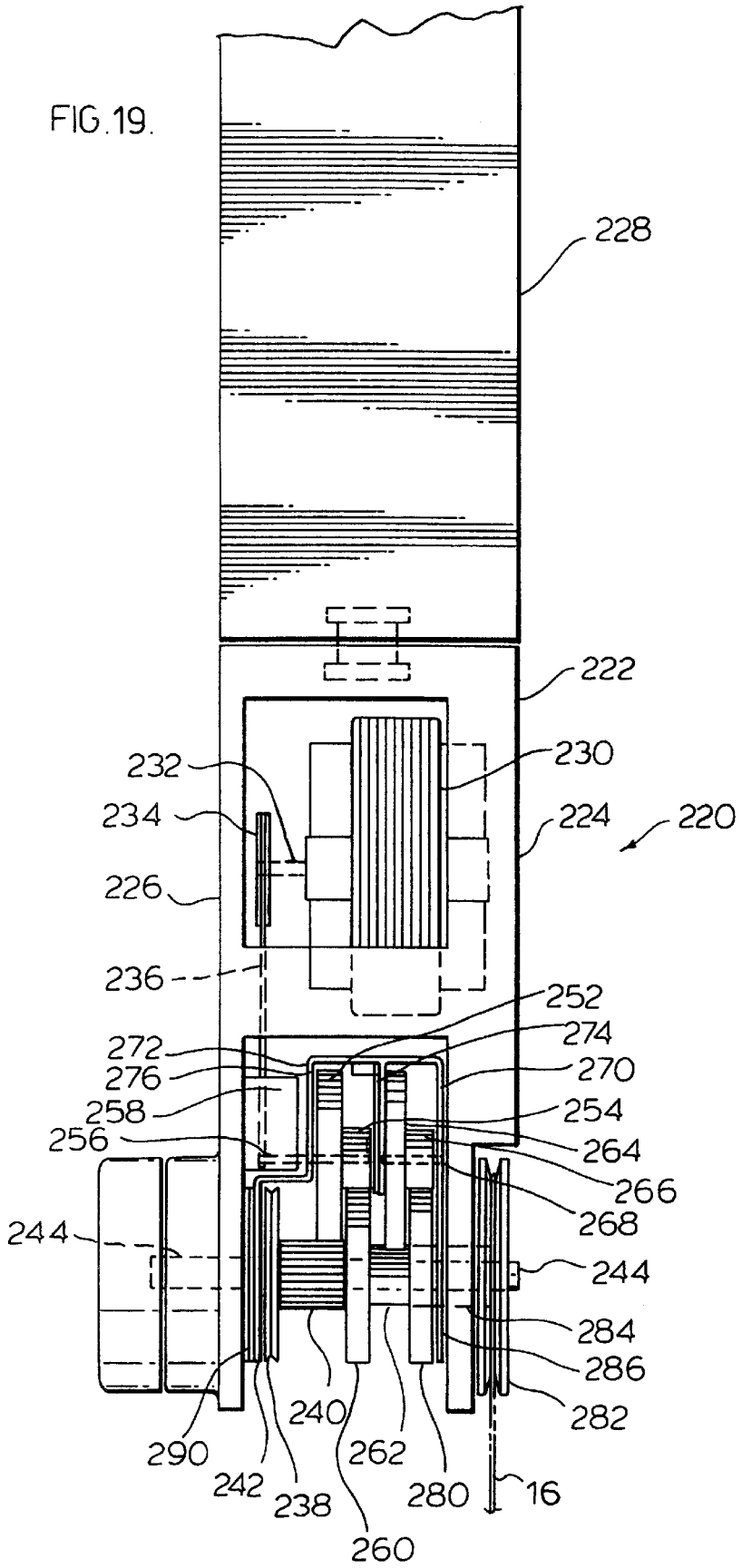
FIG. 19 is a fragmentary top plan view of another embodiment of a drapery actuator in accordance with the present invention.
Figure 20:
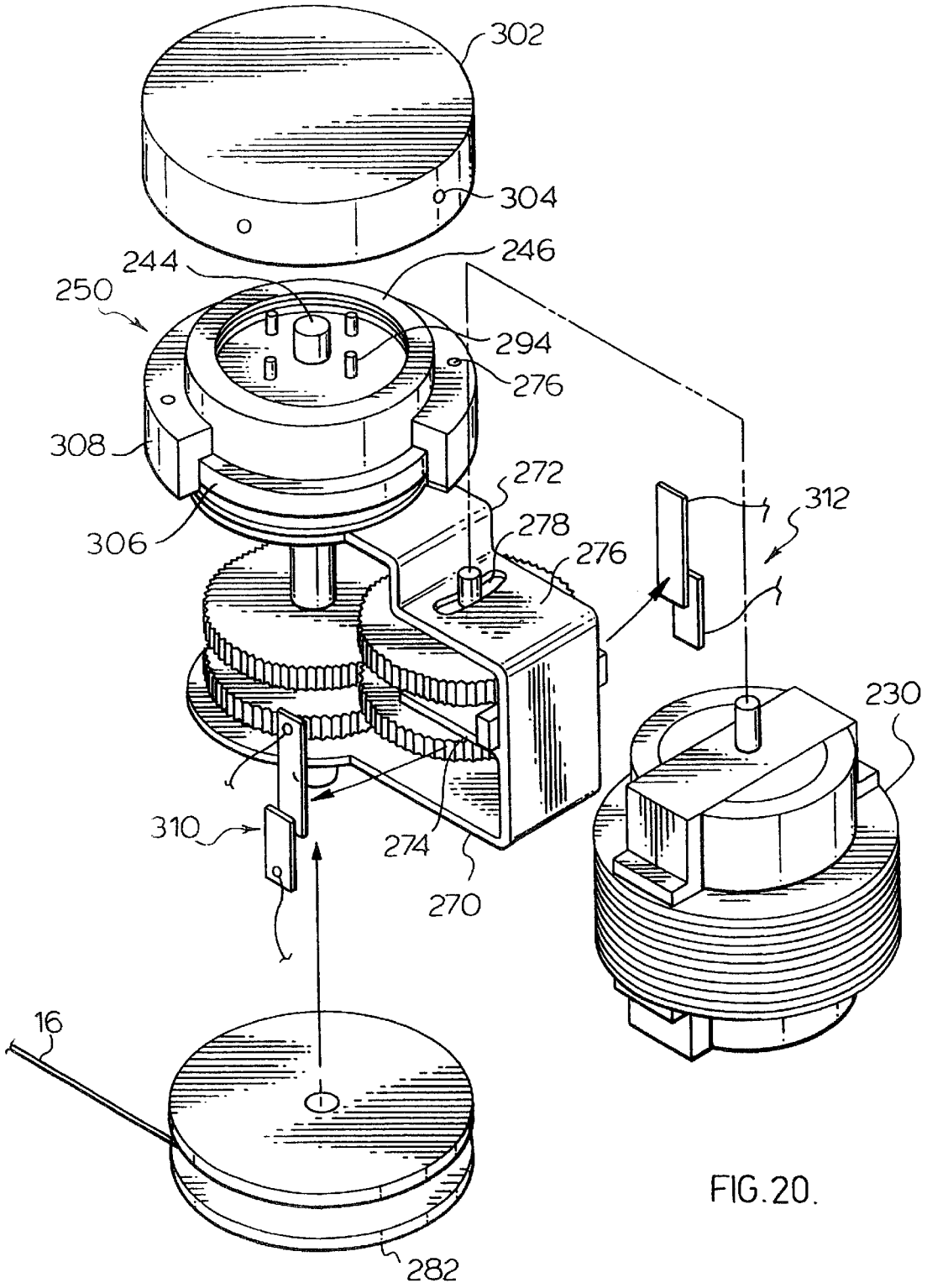
FIG. 20 is an exploded perspective view of the means for actuating the actuator arm shown in FIG. 19.

The front section 28 may be rotated 180° to the end section 26 in the directions shown by arrow C in FIG. 13. Specifically, the front face 140 of the end section 26 has a recess 142 which is approximately three quarters about the circumference of a plug 144 which extends from the front face 140. The plug 144 has a groove 145 proximate its distal end. As shown in FIG. 14, the plug 144 has a larger diameter contained within the wall 72 and has a flange 143 which fits within an annular recess in the wall 72 to maintain the plug 144 within the wall 72. Wires 146 pass through the plug 144 to connect the receiver circuit within the end section 26 to the motor 86. The front section 28 has a pawl 148 which fits into the recess 142 to allow rotation of the front section 28. The plug 144 fits through an aperture 150 in the front section 28. A ring 152 fits within the groove 145 to secure the end section 26 to the front section 28 and to allow movement of the front section 28. As noted above, rods 68 and 70 are inserted into the wall 72. Rings 147 and 149 fit about grooves 145 in the rods 68 and 70 to maintain them in place.

FIGS. 15A, 15B and 16A, 16B show a preferred circuit for the remote control transmitter 80 of the drapery actuator 20. The wireless remote control transmitter 80 may be fabricated from commercially available components such as resistors 154, integrated circuit 156, transistors 158, diodes 160, capacitors 162, light emitting diodes 164, battery 166, switch push buttons 168, pads 170 and coil 172. Connections may be made at selected ones of pads 11–20 to establish a unique transmission code. Corresponding connections are made on pads 1–10 in FIG. 18B to set the corresponding transmission code. This prevents a remote controller from transmitting a signal to an unintended drapery actuator 20. FIGS. 17A, 17B and 18A, 18B show a preferred circuit for the corresponding receiver circuit 179 contained within the end section 26 and which is fabricated from commercially available components such as those used for the remote control transmitter and DC jack 174, positive voltage regulator 176 and header 178, to provide appropriate power to motor 86 to operate it in forward and reverse directions.

Operation of the drapery actuator 20 to open and close drapes will be described with reference to FIGS. 1–18B.

In operation, the bracket 32 of the drapery actuator 20 is mounted on a support surface such as on the wall 17 as shown in FIGS. 1–4. The drapery actuator 20 engages the drapery cord 16. The front section 28 may be rotated, if required, to enable the drive pulley 132 to engage the drapery cord 16 in an appropriate manner when the drapery actuator 20 is mounted proximate the drapery cord 16. The drapery actuator 20 may also be mounted on the wall 17 in similar fashion in an upright position as shown in FIG. 3.

The housing 24 of the drapery actuator 20 is moved to different positions on the bracket 32 to ensure that the drapery cord 16 engages the drive pulley 132 under proper tension. Further tensioning of the drapery cord 16 about the drive pulley 132 is accomplished by using the tension maintenance mechanism 56. The tension maintenance mechanism 56 maintains proper engagement between the drapery cord 16 and the drive pulley 132, since the drapery cord 16 can lengthen slightly after use through wear or stretching of the drapery cord 16.

When drapery actuator 20 is correctly mounted to wall 17, the motor 86 can then be actuated by pressing the appropriate switch 168 on the remote controller 80 at some distance from the housing 24. Receiver circuit 179 receives the signal from the transmitter 80 and supplies appropriate power to the motor 86 to rotate the worm gear 88 which rotates gears 90 and 92. Gear 92 engages gear 107, thus, the rotation of motor 86 causes gears 107 and 108 to rotate and gear 110 which engages gear 108. The rotation of the gear 110 rotates the drive pulley 132 which is joined to the gear 110 by the collar 134.

When opening drapes 10 and 12 to a fully open position as shown in FIG. 1, drapes 10 and 12 encounter a stop 18 inhibiting further movement of the drapery cord 16. The drive pulley 132 and gear 110 stop when this preselected tension level on the drapery cord 16 has been met and the planetary gears 107 and 108 continue to rotate. The adjustable tension limiting means 119 is adjusted to set this preselected tension level. The gears 107 and 108 rotate around gears 92 and 110 thereby causing the actuator arm 94 to pivot towards the electrical switch 136. The actuator arm 94 then engages and closes the switch 136, thereby causing the motor 86 to stop.

To close drapes 10 and 12, an appropriate switch push button 168 on the remote controller 80 is selected to provide a signal to the receiver circuit 179 in the housing 24. Receiver circuit 179 supplies appropriate power to motor 86 to rotate the gears in the opposite direction to the rotation direction of the gears for opening drapes 10 and 12. As the drive pulley 132 winds the drapery cord 16 to close drapes 10 and 12, drapes 10 and 12 contact each other inhibiting further movement of the drapery cord 16. Once again, as the rotation of the drive pulley 132 and gear 110 ceases when the drapery cord 16 has met a preselected tension level, the planetary gears 107 and 108 rotate around gears 92 and 110 thereby causing the actuator arm 94 to pivot and contact and close the electrical switch 138 causing the motor 86 to stop. Setting of the preselected tension level will vary depending upon the size, arrangement and weight of drapes 10 and 12 and curtain rod 14 and/or other factors as will be apparent to those skilled in the art and can be determined empirically when installing the drapery actuator 20.

Adjusting wheel 122 of the adjustable tension limiting means 119 may be rotated to compress the compression spring 124 between the inner wheel 120 and the hub 116. This causes the friction between the hub 116, the rubber sheath 114 and between the rubber sheath 115 and the side 82 to increase. This increases the tension level in drapery cord 16 at which the actuator arm 94 will pivot between the electrical switches 136 and 138 and decreases the speed at which the actuator arm 94 pivots. Thus, the maximum tension level in the drapery cord 16 can be set as desired. For long draperies, the tension at which the actuator arm 94 will engage switches 136 and 138 must be increased otherwise the actuator arm 94 can prematurely engage switches 136 and 138 and cause the motor 86 to stop when drapes 10 and 12 are not fully closed or not fully open. The adjusting wheel 122 may also be manipulated to decrease the compression of the compression spring 124 such that the motor 86 is deactivated when drapes 10 and 12 are in a partially open position, if desired.

It will be realized that the drapery actuator 20 can be designed with a fixed preselected tension level and it is contemplated that this level would be selected as slightly less than the stall level of the motor 86. However, it is preferred to set the amount of compression of the drapes 10 and 12 when in an open position by using an adjustment mechanism as described above.

The drapery actuator 20 also has means to allow drapes 10 and 12 to be moved along the curtain rod 14 to a variety of selected positions. An appropriate switch 168 on the remote controller 80 is depressed and held which transmits a signal to the receiver circuit 179 within the housing 24 such that the motor 86 is actuated but switches 136 and 138 are not active. While this pad is depressed, the drapery actuator 20 moves the drapery cord 16 and drapes 10 and 12 in one direction. The movement of the drapery cord 16 ceases when the push pad is released, thus, the positioning of drapes 10 and 12 can be selected. Another similar switch 168 on the remote controller 80 moves the drapery cord 16 in the opposite direction by rotating the motor 86 in the opposite direction while the switch 168 is pressed and, again, switches 136 and 138 are not active. The actuator arm 94 will contact switches 136 and 138 but since switches 136 and 138 are not activated, the motor 86 does not automatically stop.

The remote controller 80 also has a switch 168 to stop the motor 86 when the actuator arm 94 is between the switches 136 and 138 to prevent further movement of the drapery cord 16 at any time after actuation of the motor 86.

FIGS. 19–22 show another embodiment of a drapery actuator 220 in accordance with the present invention. The drapery actuator 220 has a front section 222 with sides 224 and 226 and an end section 228. The front section 222 may be rotated 180° to the end section 228 based on the joinder of the front section 222 and end section 228 discussed above.

A reversible DC motor 230 or a universal motor is located in the front section 222 proximate the end section 228. A drive shaft 232 extends from the motor 230 and has a drive pulley 234 at its distal end.

A belt 236 connects the drive pulley 234 and a drive pulley 238. If required, it is contemplated that the drive pulleys 234 and 238 may be connected by a pair of belts 236. The drive pulley 238 has a gear 240 extending therefrom. The drive pulley 238 and the gear 240 are rotatable on a collar 242. The collar 242 rotates on a shaft 244 which is inserted within the collar 242 and passes through an aperture in an adjusting wheel 246 and through an aperture in the side 224 into the adjustable tension limiting means 250. The adjustable tension limiting means 250 is discussed below.

The gear 240 engages a gear 252 which has more teeth than the gear 240. The gear 252 has a gear 254 extending therefrom and which has fewer teeth than the gear 252. The gears 252 and 254 rotate on a shaft 256 which is affixed to a block 258 which protrudes from the side 226.

Gear 254 engages a gear 260 which has a gear 262 extending therefrom, gear 262 having fewer teeth than the gear 260. Gears 260 and 262 rotate on the shaft 244. Gear 262 engages planetary gear 264 which has another planetary gear 266 with fewer teeth extending therefrom. The planetary gears 264 and 266 rotate on a shaft 268 which is affixed to an arm 270 of an actuator arm 272 and an inner wall 274. The inner wall 274 is located between the arm 270 and another arm 276 of the actuator arm 272. The arm 276 has an arc-shaped aperture 278 which allows the actuator arm 272 to pivot within a predefined range.

The gear 266 engages a gear 280. The gear 280 and a drive pulley 282 are affixed to a collar 284 rotates on the shaft 244. A drive pulley 282 is disposed proximate the side 224 of the front section 222 and engages the drapery cord 16. The arm 276 of the actuator arm 272 pivots on the shaft 244 and the arm 270 pivots on the collar 284 at the same time. A rubber sheath 286 is affixed to the arm 270. Another rubber sheath 290 is affixed to the arm 276.

Figure 21:
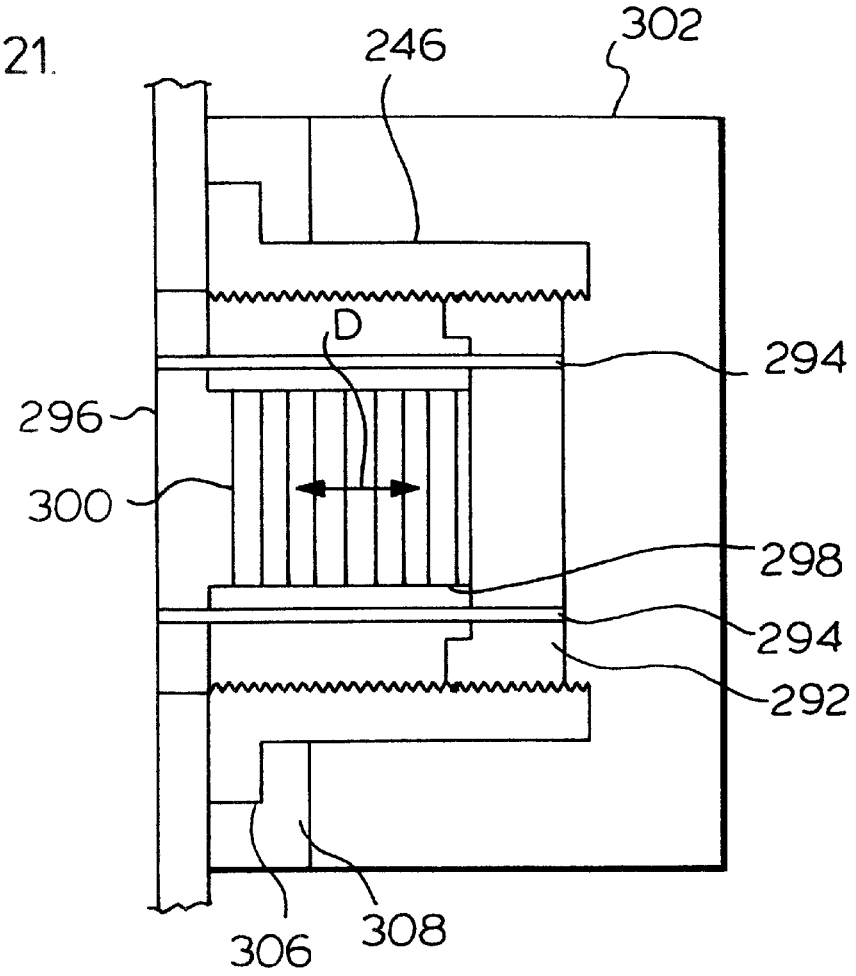
FIG. 21 is a cross-sectional top plan view of the adjustable tension limiting means of the drapery actuator shown in FIG. 19.
Figure 22:
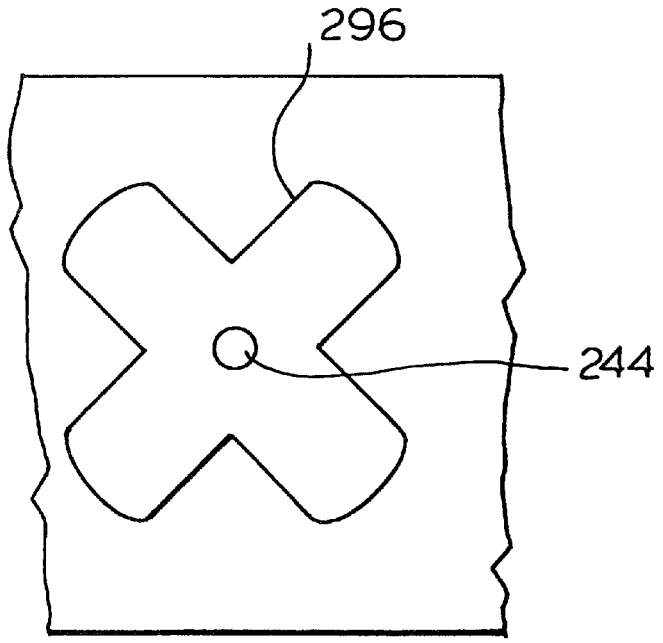
FIG. 22 is a fragmentary side view of the hub of the adjustable tension limiting means shown in FIG. 21.

The drapery actuator 220 contains an adjustable tension limiting means 250. The adjustable tension limiting means 250 comprises an adjusting wheel 246 which is threaded onto an inner wheel 292 (FIG. 21). The pins 294 join the inner wheel 292 to a hub 296. The pins 294 allow movement of the inner wheel 292 to and away from the hub 296, as shown by arrow D in FIG. 21, but prevent rotation of the inner wheel 292. The hub 296 has a shaft 298 and a compression spring 300 is about the shaft 298. As shown in FIG. 22, the hub 296 is substantially clover-shaped and fits within a clover-shaped opening in the side 226 such that the hub 296 does not rotate but moves to and away from the side 226 towards and away from the rubber sheath 290.

A first cover 302 has a plurality of screws 304 about its circumference which affix the cover 302 to the adjusting wheel 246.

The adjusting wheel 246 has a flange 306. A second cover 308 prevents the adjusting wheel 246 from being removed from the drapery actuator 220.

In operation, the cover 302 of the adjustable tension limiting means 250 is rotated in a first direction. This rotates the adjusting wheel 246 which rotates the inner wheel 292 along the shaft 298 of the hub 296. This compresses the spring 300. Compression of the spring 300 moves the hub 296 towards the rubber sheath 290 and, therefore, moves the rubber sheath 286 towards the side 224 which increases the friction on the arms 270 and 276 of the actuator arm 272 thereby changing the tension level in drapery cord 16 at which the actuator arm 272 pivots between normally open electrical switches 310 and 312. Rotation of the inner wheel 292 in the opposite direction allows the compression spring 300 to stretch thereby moving the hub 296 away from the rubber sheath 290 and decreasing the friction on the arms 270 and 276. This allows the tension level at which the actuator arm 272 will pivot to decrease.

Similar remote controller and receiver units may be used as described above and similar circuits may be used for such controls as described above. As with the preceding embodiment, a bracket and a tension maintenance mechanism may be provided to vary the tension of the drapery cord 16.

Operation of the drapery actuator 220 to open and close drapes will be described with reference to FIGS. 19–22. In operation, the drapery actuator 220 is mounted on a wall as described above. The drapery actuator may include a bracket and a tension maintenance mechanism as described above in respect of the first embodiment.

In operation, the bracket of the drapery actuator 220 is mounted on a support surface such as on a wall or ceiling. The drive pulley 282 engages the drapery cord 16 which engages drapes. The tension of the drapery cord 16 is adjusted appropriately.

The motor 230 is then actuated by pressing the appropriate switch on the remote controller at some distance from the drapery actuator 220. A receiver located in the drapery actuator 220 receives the signal from the remote controller and supplies appropriate power to the motor 230 which then rotates the drive pulley 234 which rotates the pulley 238 and gear 240 by belt 236. Gear 252 engages gear 240, thus, this action causes gears 252 and 254 to rotate about the shaft 256. The engagement of the gears then rotates gears 260, 262, 264, 266 and 280. The rotation of the gear 280 rotates the drive pulley 282 which is joined to the gear 280 by the collar 284. The drapes may then be opened or closed depending upon the direction or rotation of motor 230.

Upon the drapes reaching an extreme position such as a fully open position, the drapes encounter a stop inhibiting further movement of drapery cord 16. The drive pulley 282 and gear 280 slow to a stop when the drapery cord 16 has reached a preselected tension level and the motor 230 causes the planetary gears 264 and 266 to continue to rotate, thus, the gears 264 and 266 rotate about gear 280 thereby causing the actuator arm 272 to rotate towards the electrical switch 310. The actuator arm 272 then abuts and closes the switch 310, thereby causing the motor 230 to stop.

To close the drapes, an appropriate switch on the remote controller is pressed to provide a signal to the receiver circuit in the drapery actuator 220. The motor 230 then rotates the gears in the opposite direction to the rotation of the gears for opening the drapes. As the drive pulley 282 winds the drapes towards each other to close the drapes, the drapes contact each other inhibiting further movement of the drapery cord 16. Once again, the rotation of the drive pulley 286 and gear 280 stops when the drapery cord 16 has reached this preselected tension level thereby causing the planetary gears 264 and 266 to abut and close the electrical switch 312 causing the motor 230 to stop.

As with the drapery actuator 20, the drapery actuator 220 also has means to allow the drapes to be moved along a curtain rod to a variety of selected positions.

Figure 23:
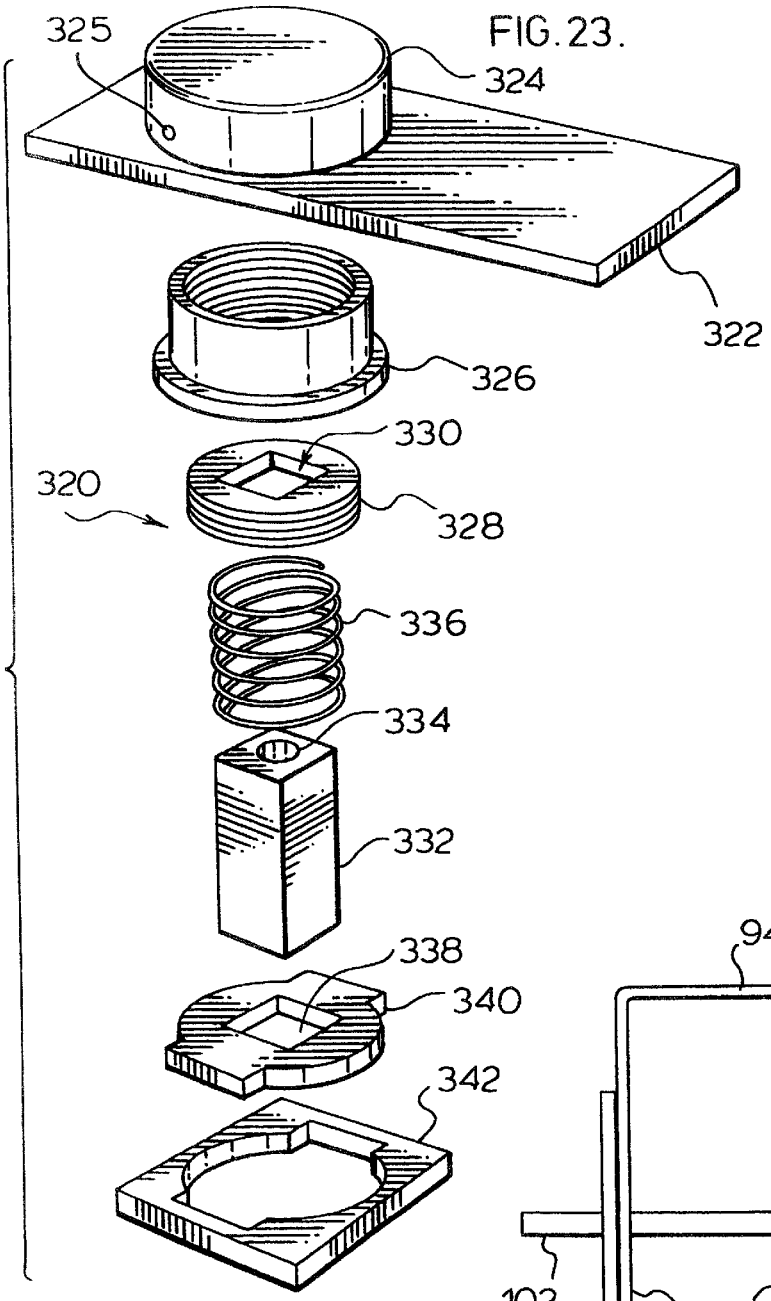
FIG. 23 is a fragmentary exploded perspective view of another embodiment of an adjustable tension limiting means.
Figure 24:
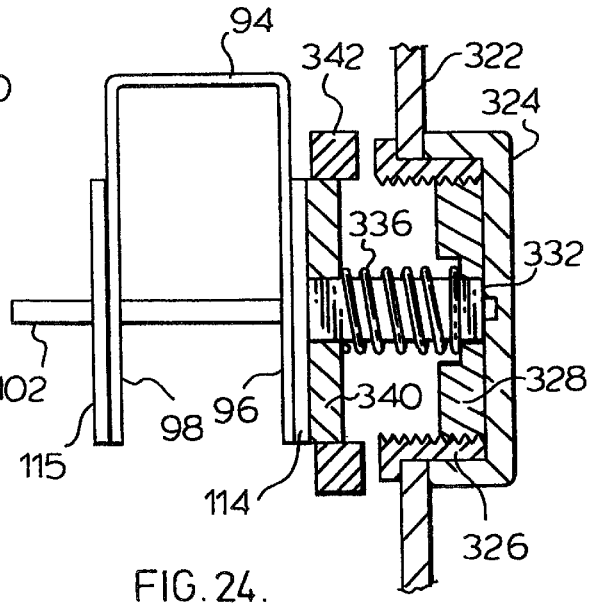
FIG. 24 is a partial fragmentary cross-sectional top plan view of the adjustable tension limiting means of FIG. 23 within the drapery actuator shown in FIG. 1.

FIGS. 23 and 24 show another embodiment of an adjustable tension limiting means indicated generally at 320 which can be used with the drapery actuator 20 or the drapery actuator 220 or the like. The drapery actuator has a side 322. A cover 324 has a number of screws 325 about its circumference which affix the cover 324 to an adjusting wheel 326. The adjusting wheel 326 is threaded onto an inner wheel 328 which has a square shaped aperture 330 for receiving a square-shaped block 332. The block 332 has an aperture 334 to allow a shaft such as shaft 102 of the drapery actuator 20 of FIG. 9 to pass through the block 332. A compression spring 336 is disposed about the block 332. The block 332 fits within a square aperture 338 of a plate 340 and is affixed to the plate 340. The plate 340 fits within another plate 342 which abuts the top and bottom of the drapery actuator such as the top 29 and the bottom (not shown) of the drapery actuator 20 between the sides 82 and 84 of the front section 28 of the drapery actuator 20.

FIG. 24 shows this embodiment of the adjustable tension limiting means 320 in use with the drapery actuator 20 of FIG. 1.

In operation, the cover 324 is rotated in a first direction. This rotates the adjusting wheel 326 which moves the inner wheel 328 along the block 332 and moves the plate 340 towards a rubber sheath of the drapery actuator 20 to increase the friction between the rubber sheath 114 and the plate 340 thereby increasing the preselected tension level. Rotation of the cover 324 in the opposite direction allows the compression spring 336 to extend thereby decreasing the friction between the plate 340 and the rubber sheath 114.

FIGS. 25–28 show other embodiments of the drapery actuator 400 of the present inventory having a torque-activated switch means which only requires a single electrical switch 424, incorporated into a clutch-drive mechanism which is indicated generally at 410. In such embodiments, clutch-drive mechanism 410 comprises a torque activated or tension limiting means 404, comprising a spring 405, a clutch shaft 440, a splined member 418, drive gear 412, a first clutch plate 408, a second clutch plate 406, a pulley shaft 416, a stabilizing bearing 409, a drive pulley 420, and an electrical switch 424.

Figure 26:
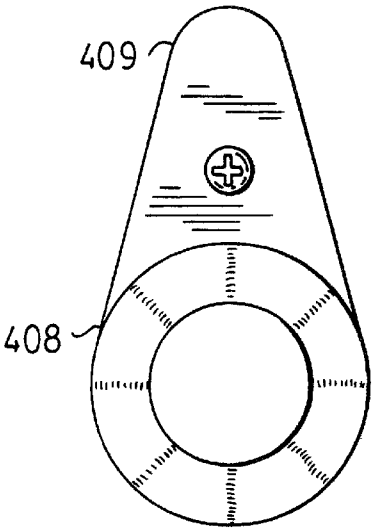
FIG. 26 is a view on arrow 'A' of FIG. 25.
Figure 25:
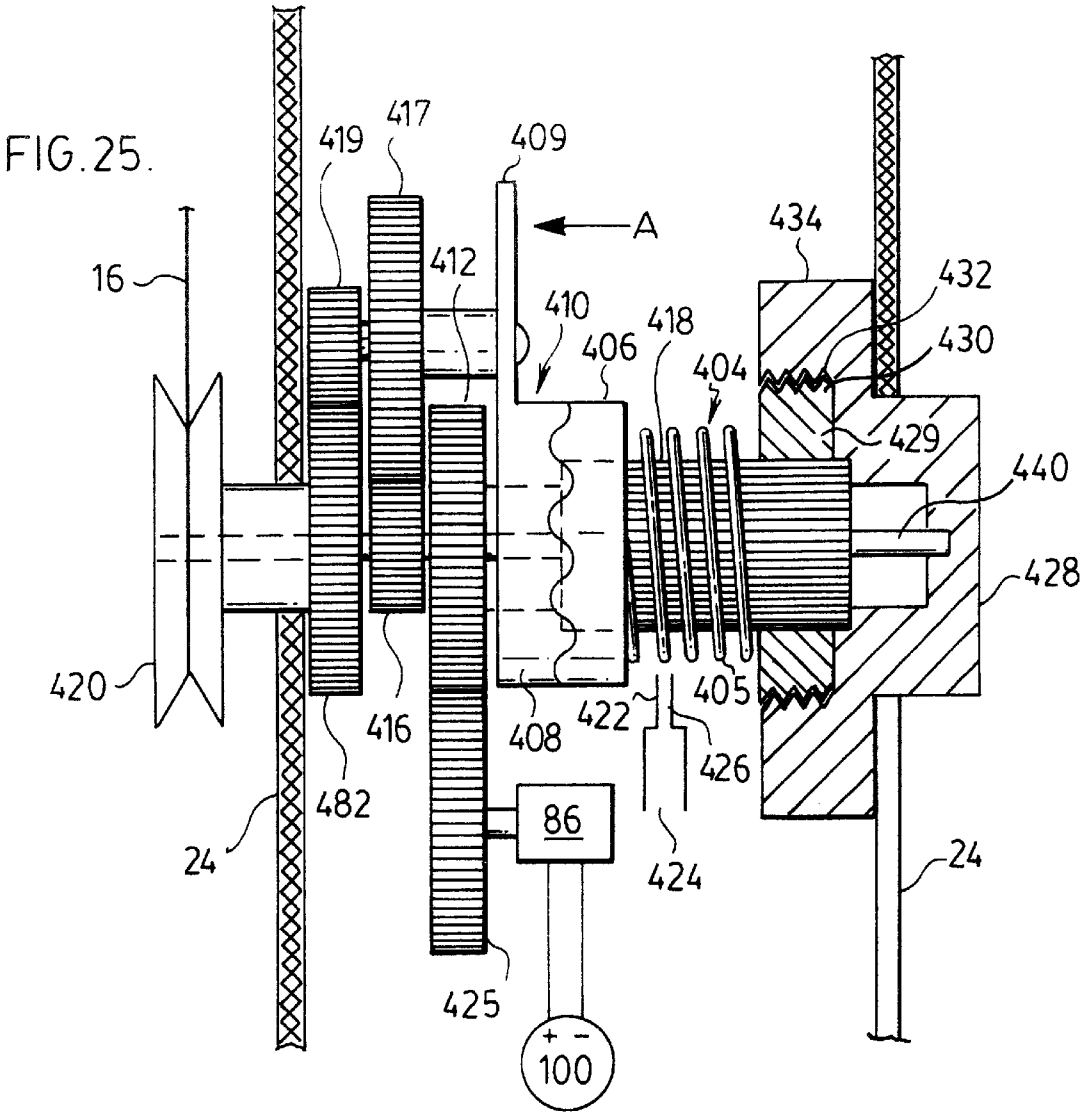
FIG. 25 is a schematic view of the torque activated switch means for the drapery actuator of the present invention.
Figure 27:
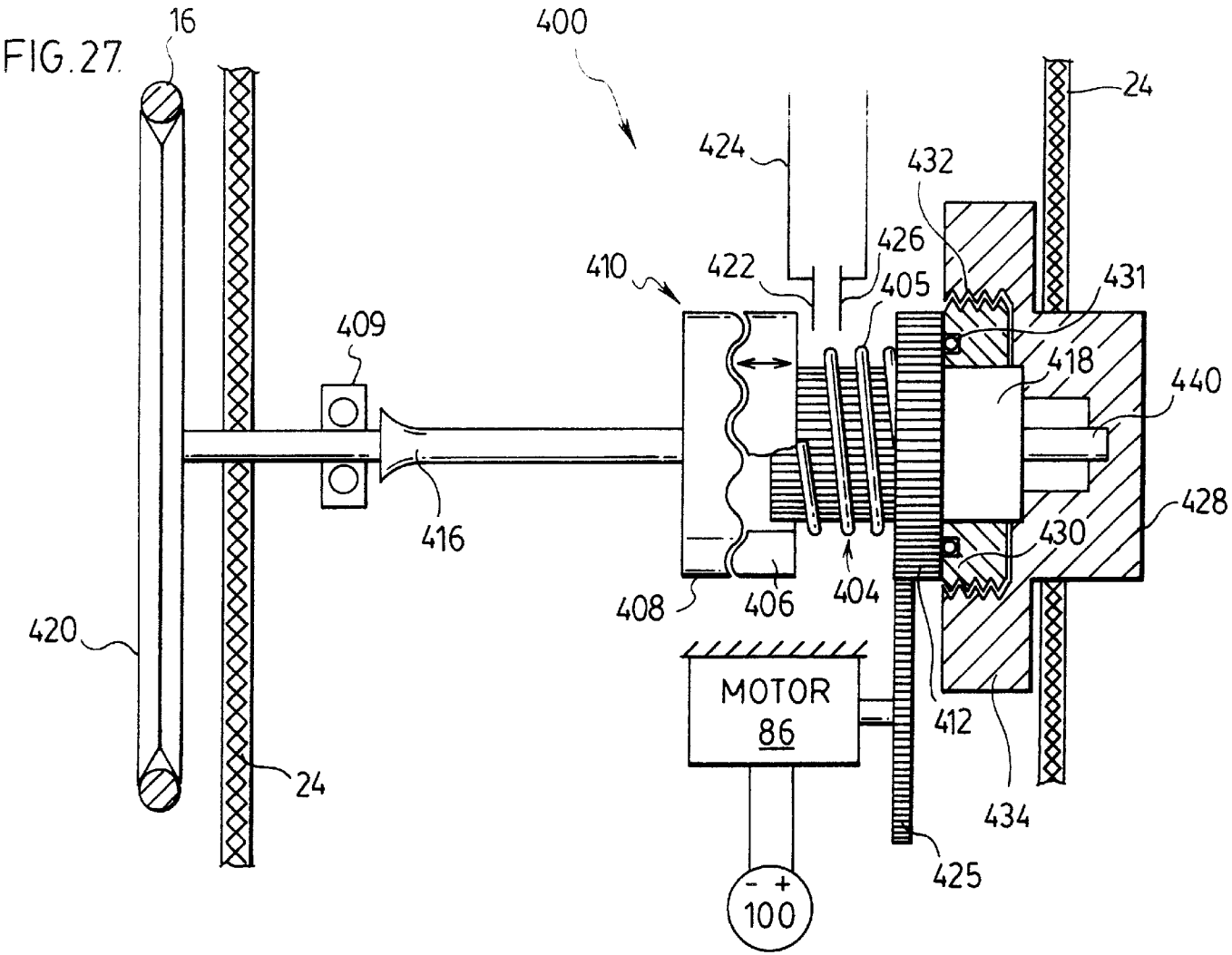
FIG. 27 is a top schematic view similar to the view shown in FIG. 25, showing an alternative arrangement for the torque activated switch means.

With reference to the above two embodiments shown in FIGS. 25–27, such embodiments comprise an adjusting wheel 428 which includes threads 432 and an axle 440. Adjusting wheel 428 is preferably fabricated as a single piece from plastic or any other suitable material. Threads 432 are engaged with interior threads 430 of ring member 429. Adjusting wheel 428 projects outside housing 24. Torque activated means 404 comprises a cylindrical spring 405 of a diameter slightly larger than splined member 418, but of smaller diameter than second clutch plate 406 and gear 412 so as to abut splined member 418 at one end and second clutch plate 406 at its other. Second clutch plate 406 is axially slidable on splined member 418 when assembled, as shown in FIGS. 25 and 27. In this regard, spring 405 exerts a lateral force against clutch plate 406, pressing it against clutch plate 408, as shown in FIGS. 25 and 26.

First clutch plate 408 may be fixedly coupled to clutch shaft 416, as shown in FIG. 25, or may simply rotate thereon but not be fixedly coupled to, clutch shaft 440, as shown in FIG. 26. In all embodiments, second clutch plate 406 is slidable, in a preferred embodiment, along splined shaft 418, but as may appear to the person skilled in the art, if either clutch plate 406 and/or clutch plate 406 and splined member 418 are together slidable, the result of the invention may be achieved. First clutch plate 408 is comprised of a radial pattern of arcuate detents 456 and a central raised clover 460. Second clutch plate 406 is comprised of a radial pattern of arcuate peaks 464 (See FIG. 28) for complementary mating with detents 456. Second clutch plate 406 (See FIG. 28) further comprises a central depressed clover 468 complementary to raised clover 460. It will be understood that various other patterns of peaks, detents, clovers or other clutch faces on each of clutch plates 406, 408 can be used without departing from the scope of the present invention.

The embodiment shown particularly in FIG. 25 will now be described in detail. In this embodiment gears reduction 412 and 482, clutch plates 406 and 408, and splined member 418 are all located co-axially about a single shaft 440, and need not be fixedly coupled thereto.

Motor 86 is provided, which through rotation of gear 425, turns (in order of turning) fixed gears 412, 416, quasi-planetary gears 417, 419, and lastly gear 482 which is directly coupled to drive pulley 420 and drapery cord 16.

Adjustable wheel 428, typically a knurled knob, is provided to adjust the torque which may be applied by the motor 86 to the drapery cord 16. Above the adjustable torque limit, the torque activated switch 424 will be activated in the manner described below, which causes the electrical current 100 motor 86 to be interrupted, and thereafter setting the motor 86 to cause it to turn in an opposite direction when electrical current 10 resupplied to the motor 86.

The torque limit for the drapery activator of the present invention is adjusted (increased) in this embodiment of the invention by turning adjustable wheel 428 in a direction which causes externally-threaded annular ring 429 to move toward the left (ref. FIG. 25), so as to cause spring 404 to become more tightly compressed between second clutch plate 406 and annular ring member 429, thereby exerting a greater force on clutch plate 406 which causes a stronger engagement between second clutch plate 406 (which is moveable) and first clutch plate 408 which is laterally fixed and prevented from lateral movement by fixed wall member 24.

The manner of operation of this embodiment of the present invention, will now be described with reference to FIGS. 25 and 26.

Upon the drapes reaching an extreme position, namely, a fully open or fully closed position, the drapery cord 16 is prevented from further movement, and thus drive pulley 420 and gear 419 are prevented from further rotation. Motor 86, however, continues to attempt to turn gear 425, gear 412, and gear 416. The spring force exerted by spring 405 is not sufficient to prevent first clutch plate 408 and quasi-planetary gears 417 and 419, each mounted on planetary arm member 409, from rotating in a planetary manner about shaft 440. Rotation of first clutch plate 408 causes second clutch plate 406 to slidably move axially rightward, and to contact switch 424, thereby contacting leads 422 and 426 together. Such switch 424 then operates to cut electrical current 100 to motor 86, and in the case of a d.c. current motor, reverses the polarity of the electrical current supplied to such motor 86, so that upon subsequent remote signal being given and current being re-supplied to the motor 86, the motor 86 will turn in an opposite direction. For example, if the drapery cord 16 had caused the drapes to reach their extreme closed position, at such position the switch 424, would be "tripped", and such switch 424, being a "flip-flop" switch typically employed in the art for such purposes, immediately interrupts the electrical current 100 supplied to the motor, in the manner described above, and reverses the polarity of the d.c. current being supplied to the motor. Subsequently, when remote signal is later provided by, for example, a hand-held infra-red signal, directing the drapes to be opened, electrical current is then directed to the motor 86, and the drive pulley 420 then turned in the opposite direction causing the drapes to open. Because the drapes, during opening and until the fully-open position, encounter no obstruction, the torque-limit of the clutch mechanism 410 is not exceeded, and quasi-planetary gears 417, 419 remain stationary on planetary arm member 409, thereby allowing torque from the motor 86 to be transmitted directly to gear 482 and thus drive pulley 420.

Similarly, when drapes are moved in the opposite direction (i.e., towards the open position) and reach the fully open position and thereafter encounter resistance in moving due to reaching the end of their travel, the above process occurs. In particular, at the extremity of travel at the fully-open position, rotation of drive pulley 420 and gear 482 is prevented. The motor 86 accordingly causes planetary arm member 409 to rotate about shaft 440, causing axial movement rightward (see FIG. 25) of second clutch plate 406. Such axial movement rightward causes switch 424 to be tripped, thereby causing interruption of electrical current 100 to motor 86.

The provision of adjusting wheel 428 is an option which advantageously allows the level of torque at which electrical current 100 to motor 86 will be "cut." This adjustment feature is useful, since drapes of longer lengths will require the torque limit to be set relatively high to allow sufficient torque to be transmitted by the motor 86 to gears 482 and drive pulley 420 to effect opening and closing of the drapes. However, where the drapes are relatively light, or the size of the window relatively small, the torque level may accordingly be set lower. By setting the torque limit lower, the motor 86 will need do less work, and longer motor life may advantageously be obtained.

To decrease the tension provided by tension limiting means 404, wheel 428 is rotated in a second direction to cause threads 432 to reversingly engage threads 430, thus causing axial movement of ring member 429 clutch away from second clutch plate 406, thereby reducing the force exerted thereon by spring 405. As spring 405 is released, clutch plate 406 is urged with less force against clutch plate 408. Accordingly, less torque is required to cause slippage between plates 406 and 410, thereby decreasing the torque required to activate switch 424 and shut off motor 86.

It is important in this embodiment that gear 482 and spindle member 418 not both be fixedly coupled to shaft 440. In the preferred embodiment, although gears 482, 416, 412, and clutch plate 408 are adapted for free rotation about shaft 440, none are fixedly coupled to shaft 440, nor for that matter is spindle member 418. In an alternative embodiment, one of such elements may be fixedly coupled to shaft 440.

Reference to and description of the embodiment shown in FIG. 27 will now be made. For ease of reference, numerical items for components shown in FIG. 25 are maintained for similar components shown in FIG. 27.

Like the embodiment shown in FIGS. 25 and 26, FIG. 27 shows a design for a drapery actuator 400 having a torque-activated switch 424 for interrupting electrical current 100 to a motor 86 when a torque limit being provided by the motor 86 is reached.

In this embodiment, for the purpose of simplicity, two gears 412 and 425 are shown, although further reduction gears may be required, as is typically known. All that is necessary for the purpose of understanding this invention is that rotational force is provided by motor 86 via a gear or reduction gears 425 to gear 412. In a first aspect (aspect 'a') of this embodiment of the invention, the gear 412 is internally splined to allow splined engagement with splined member 418 to allow slidable axial movement of gear 412 on such splined member 418. The splines prevent rotational movement of the gear 412 relative to the splined member 418. Splined member 418 is fixedly coupled to second clutch plate 406. Accordingly, in this aspect of this embodiment clutch plate 406 and splined member 418 may move axially relative to gear 418, which due to spring 405 remains pressed against ring member 429.

In a second aspect (aspect 'b') of this embodiment, gear 412 is fixedly coupled to splined member 418. Second clutch plate 406 is internally splined to allow splined engagement with splined member 418 and in particular slidable axial movement on splined member 418. The splines prevent rotational movement of second clutch plate 406 relative to splined member 418.

In both aspects of this embodiment, an adjusting wheel 428 is provided to allow adjustment of the spring force exerted by spring 405 on second clutch plate 406, and thus permit adjustment of the upper limit of the torque for which clutch mechanism 410 comprising first clutch plate 408 and second clutch plate 406 will continue to transmit torque to drive pulley 420 and thus drapery cord 16.

In the embodiment, shown in FIG. 27, first clutch plate 408 is directly coupled to shaft 416, which is held in place by bearing 409, and frame 24 and which transmits torque to drive pulley 420. Splined member 418 is fixedly or freely mounted for rotation about shaft 440, but in an instance where shaft 440 is the same as or is coupled to shaft 416, in such instance splined member 418 is freely mounted, and not fixedly coupled, for rotation about shaft 440.

Annular ring 429, co-axially mounted about spline member 418, but free to rotate relative thereto, is provided. Annular ring 429 possesses external threads 430 which engage internal threads 432 on adjusting wheel 428. Rotational movement of adjusting wheel 428 causes annular ring to be displaced rightwardly or leftwardly, causing corresponding movement of gear 412 which contacts spring member 405 causing a resulting increase or decrease in the force exerted on second clutch plate 406. This feature allows adjustment of the permissible amount of torque transmitted by clutch mechanism 410 and torque-actuated means 404 to drive pulley 420. Roller bearings 431 may be provided to decrease friction between annular ring 429 which remains rotationally stationary and gear 412 which rotates.

Notably, due to the fact gear 412 is caused to move axially when annular ring 412 is turned, gear 412 must be of a sufficient width to remain in constant contact with reduction gear 425 during the entirety of the lateral range of motion of annular ring 429, to ensure rotational driving energy is always capable of being transmitted to gear 412. This holds true for both aspect 'a' and aspect 'b' of this embodiment of the invention.

Electric switch 414, having leads 422 and 426, is provided, with such switch being a pressure actuated electronic "flip-flop" switch of the type known in the art. Such switch is positioned immediately adjacent second clutch plate 406, to allow operation of the torque activated mechanism 404 of the present invention as will now be described in detail.

The adjusting wheel 428 is first adjusted to set the desired torque limit, namely, a limit high enough so that the motor 86 will only be "tripped" in the manner herein described upon the drapes being in either the fully open, or fully closed or upon reached a desired "stop" position, but low enough so that the motor 86 will immediately be tripped upon reaching said position and not be caused to "lug" for a period of time.

Upon the drapes reaching such extreme position, say the fully closed position, the drapery cord 16 is prevented from further movement, and thus drive pulley 420 and clutch plate 408 are prevented from movement. Motor 86 continues to supply torque via reduction gear 425 to gear 412, which attempts to turn clutch plate 406. Clutch plate 406 accordingly turns, but spring force exerted by spring 405 is insufficient, at levels of torque exerted by the motor 86 when faced with an immoveable first clutch plate 408, to prevent axial (rightward) movement of clutch plate 406 (aspect 'a') or clutch plate 406 and splined member 418 (aspect 'b'), which are caused to move rightward by forced displacement due to the series of interdigitations 468 appearing in clutch plate 406 (see FIG. 28) overriding the corresponding features 456 in clutch plate 408. Clutch plate 406, due to such forced rightward motion, then contacts switch 424. Switch 424 then operates in the manner heretofore described to cut electrical current 100 to motor 86.

Figure 29:
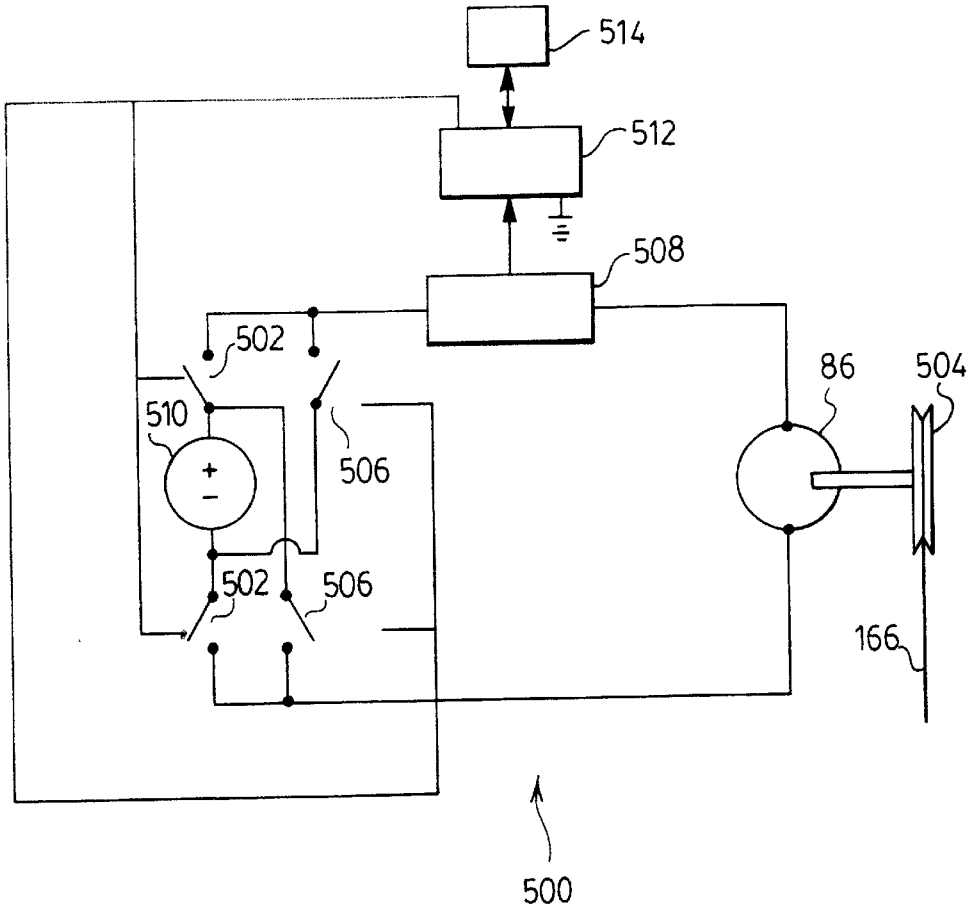
FIG. 29 is a schematic electrical circuit for an alternate embodiment of the torque actuated switch means, showing an electronic torque activated switch means.

Another embodiment of a torque-activated switch means of the present invention is shown in FIG. 29, incorporated into an electronic torque-activated switch circuit, indicated generally at 500. In this embodiment the torque-activated switch of the present invention comprises a circuit 500, which in turn comprises a power source 510, a forward electrical switch means 502, a reverse electrical switch means 506, an electronic torque-activated means 508, and a motor 86. The shaft of motor 86 is connected to pulley 504, however any suitable gear transmission from motor 86 to pulley 504 can be provided.

Electronic torque-activated means 508 is a first electronic circuit which monitors the amount of current flowing to or from motor 86. An electric switch means 512 is a second electronic circuit for detecting when the current flow exceeds a predetermined threshold and is operably connected to electronic torque-activated means 508 and switch means 502 and 506. An electronic tension limiting means 514 is any suitable means for adjusting the predetermined threshold that activates switch means 512, such as a variable resistor.

Figure 28:
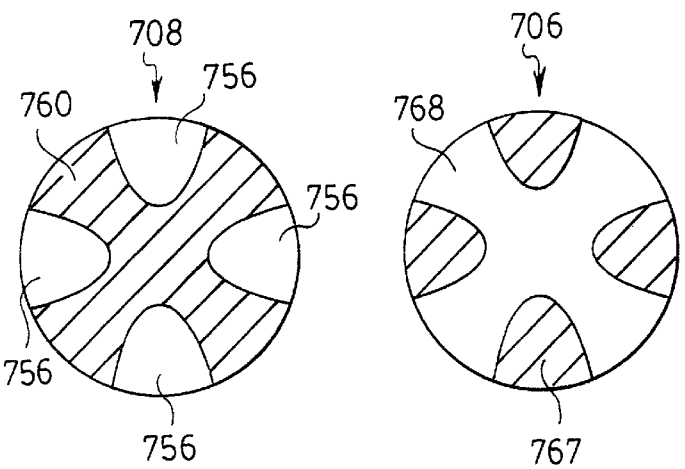
FIG. 28 is an end elevational view a first and second clutch plate shown in the drapery actuator of FIGS. 25 and 27.

The operation of the present embodiment of an electronic torque-activated switch circuit 500 will now be described with reference to the foregoing description and FIG. 28. Drapes are in the extreme open position. Electronic tension limiting means 514 is adjusted so as to require a specified threshold of electrical current to flow to motor 86 before activating the electronic torque activated switch 512. Forward electronic switch means 502 is closed using any suitable means, thus directing current to motor 86, thus actuating motor 86 to cause rotation of drive pulley 504. Electronic torque-activated means detects current flowing to motor 86, and communicates this amount of current to electronic switch means 512. During the closing operation, current is below the threshold level, and electronic switch means 512 is not activated.

Upon reaching an extreme closed position the drapes encounter a stop inhibiting further movement of drapery cord 16. Drive pulley 504 and motor 86 slow to a stop, thus creating a short circuit in the windings of motor 86. Accordingly, current flowing into motor 86 will increase until the threshold current is exceeded, thus activating the electronic switch means 512, thereby opening forward electronic switch means 502 and causing motor 86 to stop.

To open the drapes, drapes begin in the extreme closed position. Electronic tension limiting means 514 is adjusted so as to require a specified threshold of electrical current to flow to motor 86 before activating the electronic torque activated switch 512. Reverse electronic switch means 506 is closed using any suitable means, thus directing current to motor 86, thus actuating motor 86 in the open direction causing reverse rotation of drive pulley 504. Electronic torque-activation means detects current flowing from motor 86, and communicates this amount of current to electronic switch means 512. During the opening operation, current is below the threshold level, and electronic switch means 512 is not activated.

Upon reaching the extreme open position, the drapes encounter a stop inhibiting further movement of drapery cord 16. Drive pulley 504 and motor 86 slow to a stop, thus creating a short circuit in the windings of motor 86. Accordingly, current flowing from motor 86 will increase until the threshold current is exceeded, thus activating electronic switch means 512, thereby opening reverse electronic switch means 508 and causing motor 86 to stop.

To increase the tension provided by electronic tension limiting means, electronic tension limiting means 514 is adjusted in a first direction to cause the threshold level of current to increase. Accordingly, greater torque is required to trigger the threshold of level of current required to activate electronic switch means 512.

To decrease the tension provided by electronic tension limiting means, electronic tension limiting means 514 is adjusted in a second direction to cause the threshold level of current to decrease. Accordingly, less torque is required to trigger the threshold of level of current required to activate the electronic switch means 512.

It will be understood that the drapery actuator can have a plurality of drive pulleys to engage one drapery cord or a plurality of drapery cords.

Although the disclosure describes and illustrates preferred embodiments of the invention, it is to be understood that the invention is not limited to these particular embodiments. Many variations and modifications will now occur to those skilled in the art. For definition of the invention, reference is to be made to the appended claims.

I claim:

1. A drapery actuator to open and close a drape, comprising:

a housing;

a drive pulley, supported by said housing adapted to engage a drapery cord operatively coupled to said drape;

a motor, supported by said housing, adapted to provide torque for reversibly rotating said drive pulley so as to move said drapery cord in a first direction to a first position to move said drapery cord in a second opposite direction to a second position;

a first electrical switch operatively connected to said motor;

torque-activated switch means, adapted to actuate said first electrical switch when said drive pulley moves said drapery cord to said first position, and further adapted to actuate said first electrical switch when said drive pulley is reversibly rotated by said motor to move said drapery cord to said second position, so as to cause said first electrical switch to deactivate said motor when said drapery cord is moved to said first position thereby preventing further movement, and to cause said first electrical switch to deactivate said motor when said drapery cord is moved to said second position thereby preventing further movement of said drapery cord in said second opposite direction.

2. A drapery actuator as claimed in claim 1 wherein said housing includes a receiver circuit to receive a signal from a remote control to actuate said motor.

3. A drapery actuator as claimed in claim 1 wherein said drapery actuator is electrically connected to at least one electric switch to actuate said motor.

4. A drapery actuator as claimed in claim 1 wherein said motor is a direct current motor.

5. A drapery actuator as claimed in claim 4 wherein said first electric switch when activated interrupts electrical current flow to the motor, and reverses such electrical current, so that upon re-activation said first electrical switch will permit current to flow to the motor causing it to turn in an opposite direction.

6. A drapery actuator as claimed in claim 1 wherein said actuator further possesses a mounting bracket, said mounting bracket adapted to provide mounting of said actuator to a support surface.

7. A drapery actuator as claimed in claim 6, wherein said housing has means for varying the position of said housing and said drive pulley relative to said mounting bracket thereby varying the tension in said drapery cord.

8. A drapery actuator as claimed in claim 6, wherein said housing comprises a front section and an end section and said drive pulley and said motor are supported by said front section and wherein said end section has means for varying the position of said housing and drive pulley relative to said mounting bracket thereby varying the tension on said drapery cord.

9. A drapery actuator as claimed in claim 6 wherein said mounting bracket has means for varying the relative position of said housing on said support surface, thereby varying the tension on said drapery cord.

10. A drapery actuator as claimed in claim 6 wherein said housing is adapted to selectively engage said mounting bracket in any of a plurality of positions for varying the position of said housing relative to said support surface and thereby varying the tension on said drapery cord.

11. A drapery actuator as claimed in claim 6 wherein said front section is rotatably mounted to said end section.

12. A drapery actuator as claimed in claim 11 wherein said front section is rotatable 180 degrees relative to said end section.

13. The drapery actuator as claimed in claim 1, further comprising:

drape movement limiting means to prevent further movement of said drapery cord in said first direction when said drapery cord is at said first position and to prevent further movement of said drapery cord in said second direction when said drapery cord is at said second position, wherein said drape movement limiting means causes said torque provided by said motor to said drive pulley to reach an upper limit upon said drapery cord being moved to each of said first and second positions.

14. A drapery actuator as claimed in claim 1 wherein said torque-activated switch means comprises a clutch means having a first clutch plate and a second clutch plate, said second clutch plate having a first engaged position for mating engagement with said first clutch plate, and a slipping position for slipping engagement with said first clutch plate and for simultaneous activation of said first electrical switch.

15. The drapery actuator as claimed in claim 14, said second clutch slidably movable in a transverse direction from said first engaged position to said slipping position where it contacts said first electrical switch to interrupt electrical current to said motor.

16. The drapery actuator as claimed in claim 14, wherein said second clutch plate moves from said first engaged position to said slipping position upon torque transmitted to said first and second clutch plate reaching an upper limit.

17. The draper actuator as claimed in claim 16, wherein ease of movement of said second clutch plate from said first engaged position to said slipping position is adjustably preselectable.

18. A drapery actuator as claimed in claim 1 wherein said torque-activated switch means is a first electronic circuit for monitoring quantum of current flowing into said motor, and wherein said first electric switch is a second electronic circuit for detecting when said current flow exceeds a predetermined threshold and thereafter deactivating said motor from continuing to turn in the direction which it was activated to turn.

19. A drapery actuator as claimed in claim 18 wherein said second electronic circuit further comprises a means to vary said threshold.

* * * * *